US006398458B1

(12) United States Patent
Pacitto et al.

(10) Patent No.: US 6,398,458 B1
(45) Date of Patent: Jun. 4, 2002

(54) MORTARLESS RETAINING WALL STRUCTURE WITH IMPROVED LATERAL AND LONGITUDINAL REINFORCEMENT FOR A VERTICAL, SET FORWARD AND/OR SET BACK RETAINING WALL IN WHOLE OR IN PART CONSTRUCTED BY UTILIZING STANDARDIZED BLOCKS

(75) Inventors: Frank Pacitto; Paul Pignatelli, both of Woodbridge (CA)

(73) Assignee: Designscape Enterprises Ltd., Woodbridge (CA)

( * ) Notice: Subject to any disclaimer, the term of this patent is extended or adjusted under 35 U.S.C. 154(b) by 0 days.

(21) Appl. No.: 09/693,941

(22) Filed: Oct. 23, 2000

Related U.S. Application Data

(62) Division of application No. 08/996,261, filed on Dec. 22, 1997.

(30) Foreign Application Priority Data

Dec. 24, 1996 (CA) ..... 2193942

(51) Int. Cl.[7] ..... E02D 29/02; E04C 2/04

(52) U.S. Cl. ..... 405/286; 405/284; 52/592.6; 52/604

(58) Field of Search ..... 405/284, 285, 405/286, 262; 52/592.1, 592.2, 592.3, 592.4, 592.5, 592.6, 603, 604

(56) References Cited

U.S. PATENT DOCUMENTS

| | | | | |
|---|---|---|---|---|
| 468,838 A | | 2/1892 | Steiger | |
| 1,639,063 A | | 8/1927 | Stevens | |
| 2,094,167 A | | 9/1937 | Evers | 61/47 |
| 2,313,363 A | | 3/1943 | Schmitt | 61/39 |
| 2,668,435 A | | 2/1954 | Clements | 72/41 |
| 2,703,487 A | | 3/1955 | Ossoinak | 72/41 |
| 3,422,588 A | | 1/1969 | Stewart, Jr. | 52/285 |
| 3,534,518 A | | 10/1970 | Zagray | 52/258 |
| 3,643,392 A | | 2/1972 | Martinez | 52/262 |
| 4,107,894 A | | 8/1978 | Mullins | 52/593 |
| 4,193,718 A | | 3/1980 | Wahrendorf et al. | 504/286 |
| 4,229,123 A | | 10/1980 | Heinzmann | 405/273 |
| 4,314,431 A | * | 2/1982 | Rabassa | 52/259 |
| 4,319,440 A | | 3/1982 | Rassias et al. | 52/438 |
| 4,490,075 A | | 12/1984 | Risi et al. | 405/273 |
| 4,512,685 A | | 4/1985 | Hegle | 405/284 |
| 4,524,551 A | | 6/1985 | Scheiwiller | 52/98 |
| 4,671,039 A | | 6/1987 | Hunt | 52/593 |
| 4,671,706 A | | 6/1987 | Giardini | 405/286 |
| 4,815,897 A | | 3/1989 | Risi et al. | 405/284 |
| 4,824,293 A | | 4/1989 | Brown et al. | 405/284 |
| 4,860,505 A | | 8/1989 | Bender | 52/98 |
| 4,990,116 A | * | 2/1991 | Chen | 52/592.6 |
| 4,993,206 A | * | 2/1991 | Pardo | 405/284 |
| 5,031,376 A | | 7/1991 | Bender et al. | 52/609 |
| 5,064,313 A | | 11/1991 | Risi et al. | 405/284 |
| 5,120,164 A | * | 6/1992 | Iacocca et al. | 405/284 |
| 5,160,212 A | | 11/1992 | Vauhkonen | 403/294 |
| 5,248,226 A | | 9/1993 | Risi et al. | 405/284 |

(List continued on next page.)

*Primary Examiner*—David Bagnell
*Assistant Examiner*—Frederick L. Lagman
(74) *Attorney, Agent, or Firm*—Neil H. Hughes; Ivor M. Hughes; Marcelo K. Sarkis

(57) ABSTRACT

A corner block joined at the side edges thereof and including two mirror image blocks joined at said edge, each of said blocks having a pair of exposed faces, at least one of said faces including a removable portion separated from said block by a scoreline so as to allow an installer to remove said removable portion, wherein said corner block may present a pair of smooth faces when exposed, or alternatively a smooth and a rough split face as exposed, wherein said blocks including key-receiving key ways disposed proximate the top and bottom thereof.

9 Claims, 31 Drawing Sheets

U.S. PATENT DOCUMENTS

| | | | | | |
|---|---|---|---|---|---|
| 5,252,017 | A | | 10/1993 | Hodel | 411/446 |
| 5,282,700 | A | | 2/1994 | Rodrique | 405/284 |
| 5,598,679 | A | * | 2/1997 | Orton et al. | 405/286 |
| 5,619,835 | A | * | 4/1997 | Bailey, II et al. | 405/286 |
| 5,622,456 | A | * | 4/1997 | Risi et al. | 405/284 |
| 5,647,185 | A | * | 7/1997 | Forlini | 405/284 |
| 5,715,635 | A | * | 2/1998 | Sherwood | 52/592.6 |
| 5,795,105 | A | * | 8/1998 | Guth | 405/284 |
| 5,816,749 | A | * | 10/1998 | Bailey, II | 405/284 |
| 6,082,933 | A | * | 7/2000 | Maguire et al. | 405/286 |
| 6,178,715 | B1 | * | 1/2001 | Pacitto et al. | 52/604 |

* cited by examiner

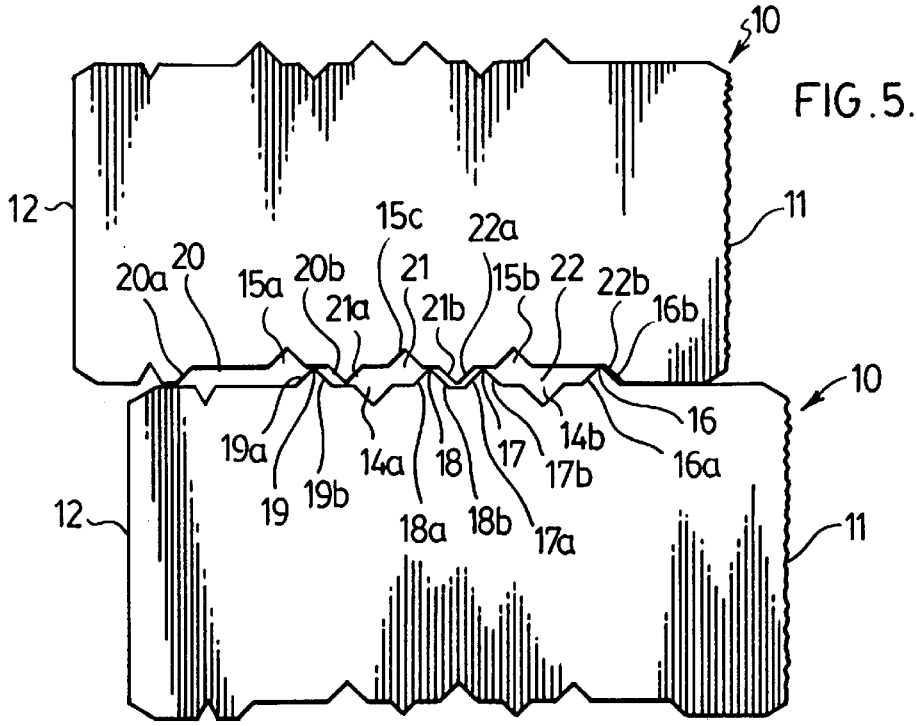
FIG. 5.
FIG. 6.
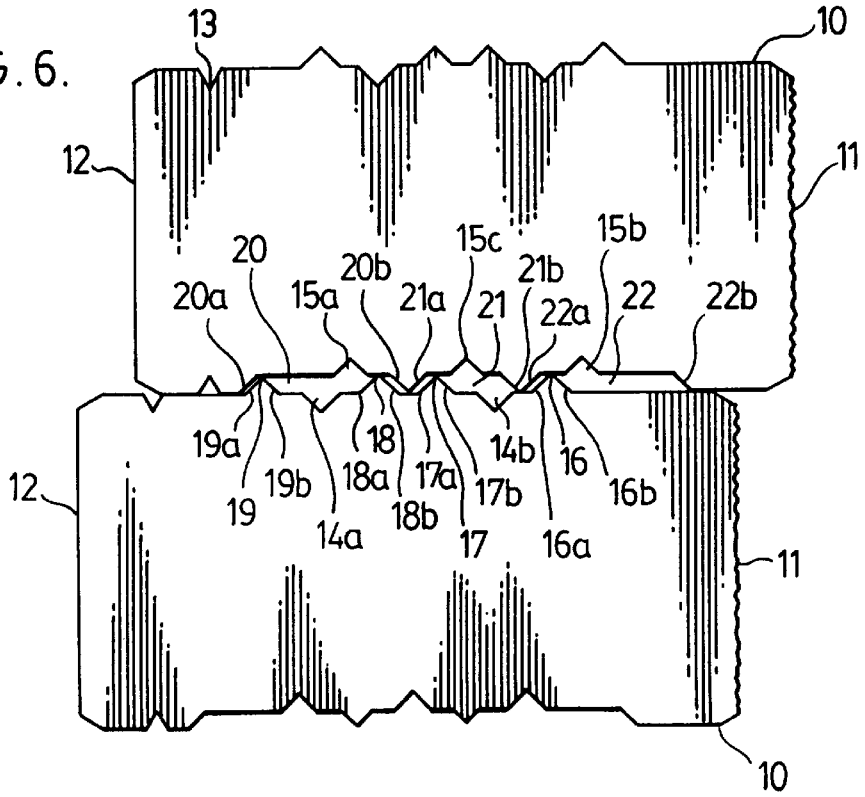

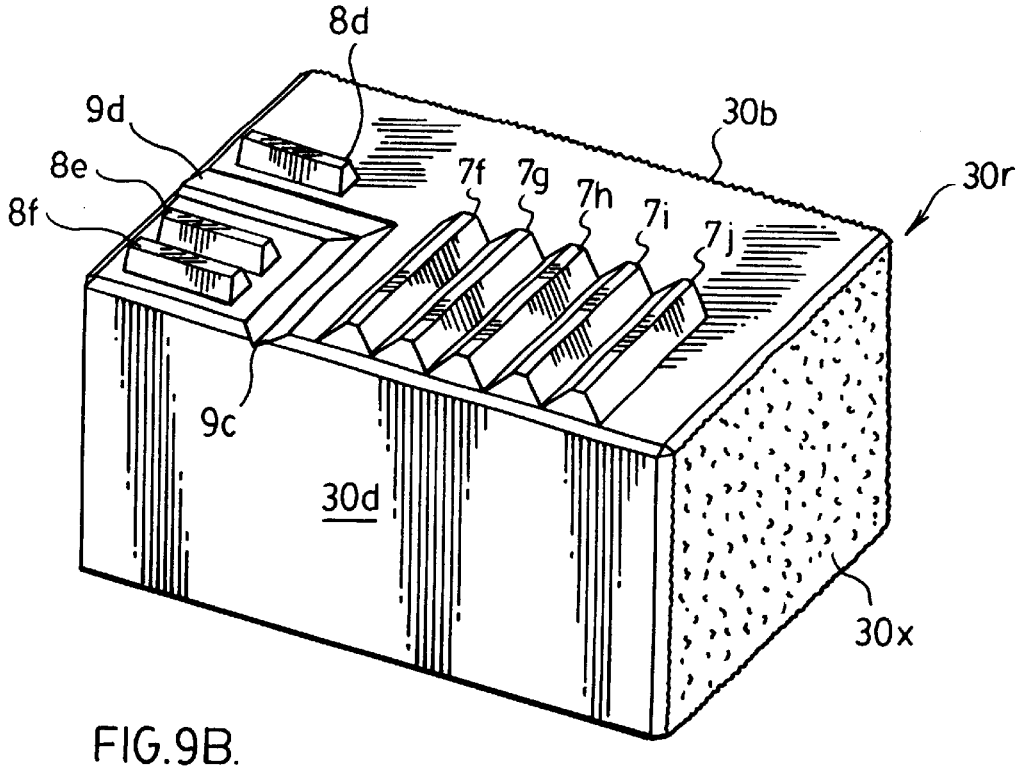
FIG.9B.
FIG.10B.
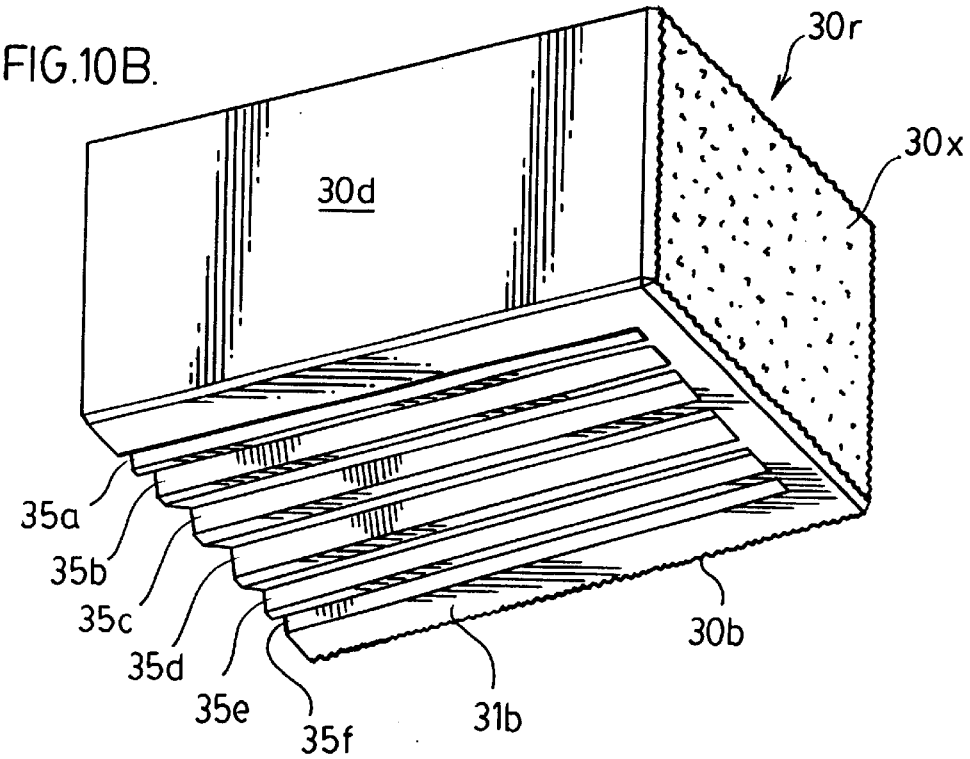

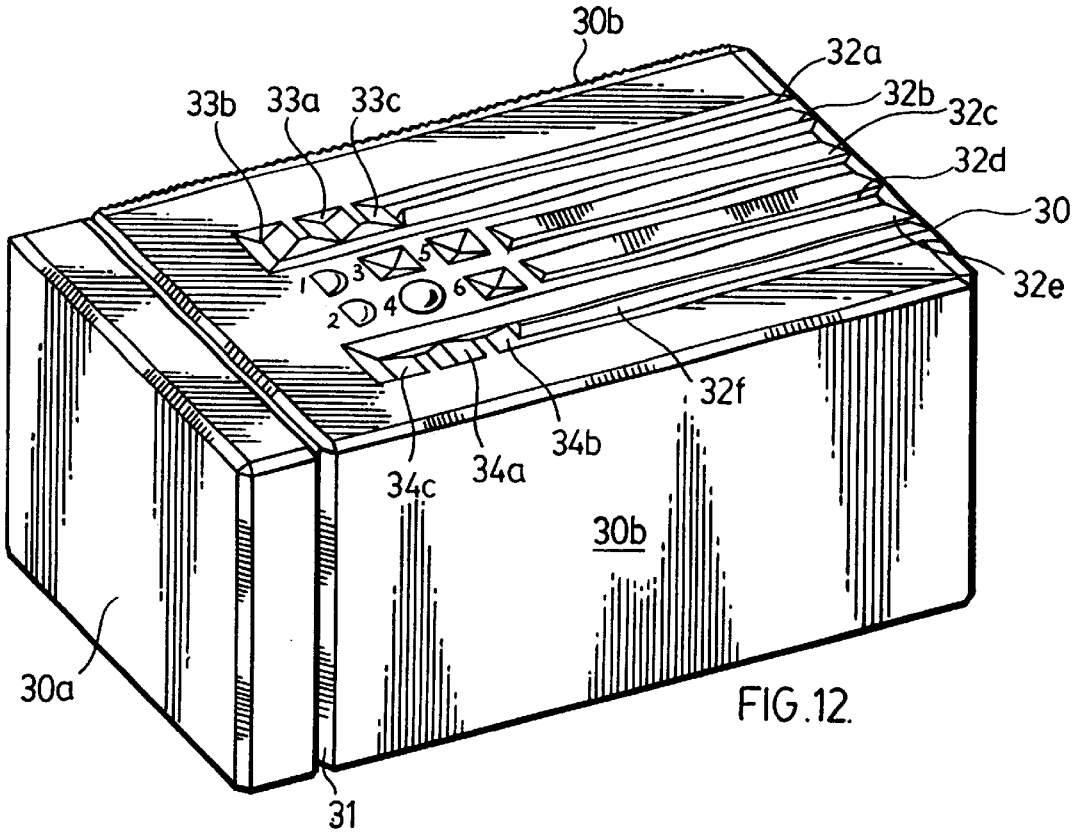
FIG.12.
FIG.13.
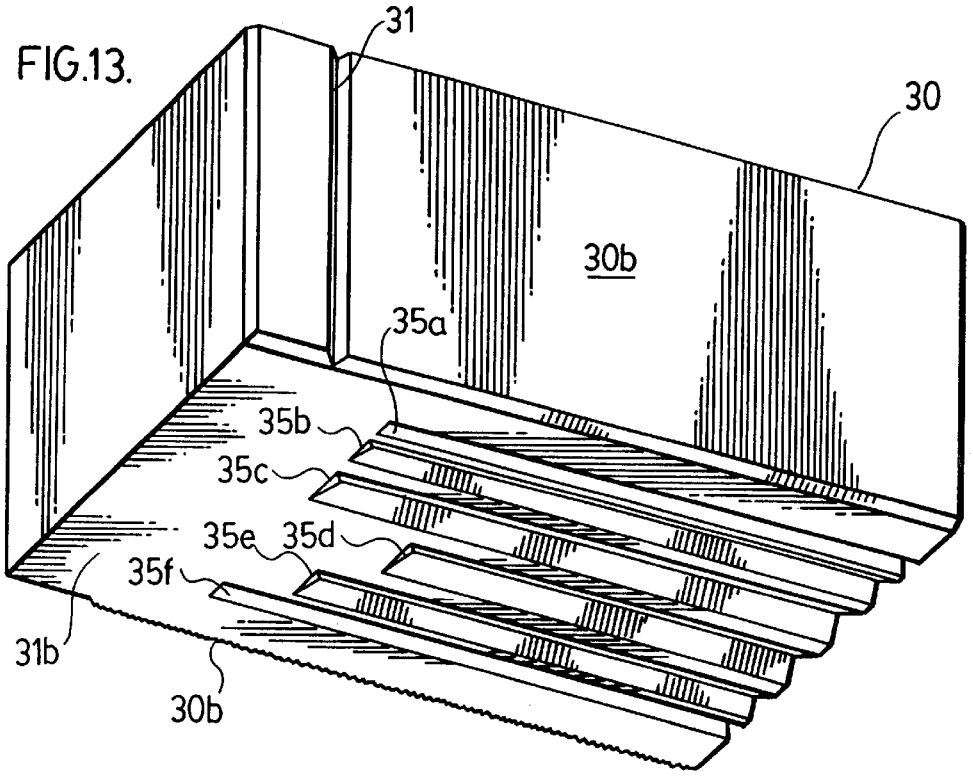

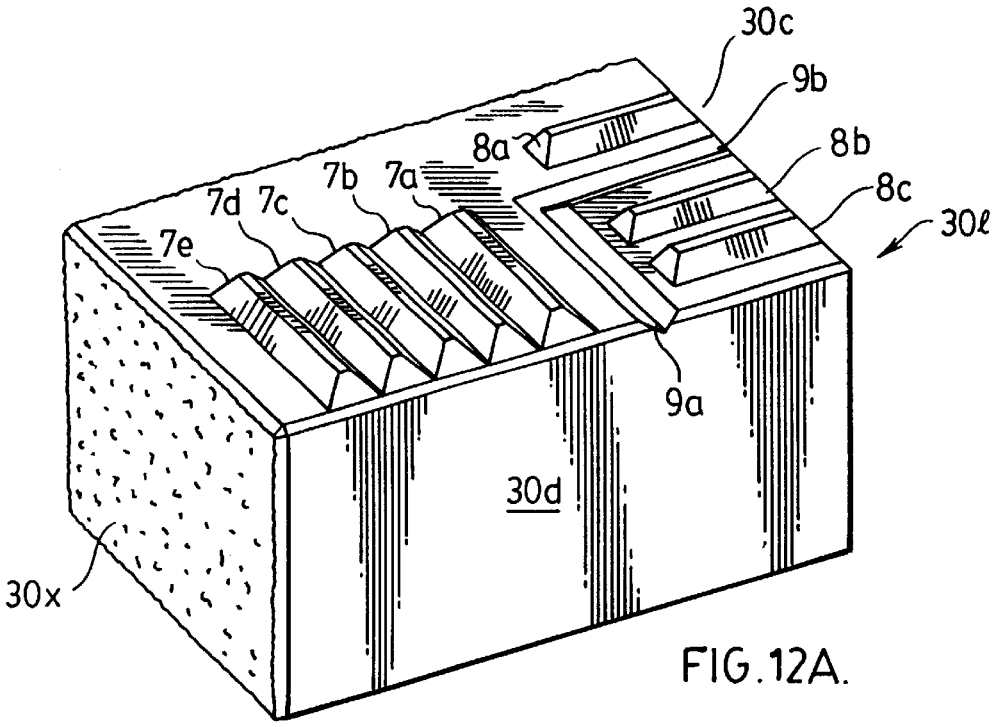
FIG.12A.
FIG.13A.
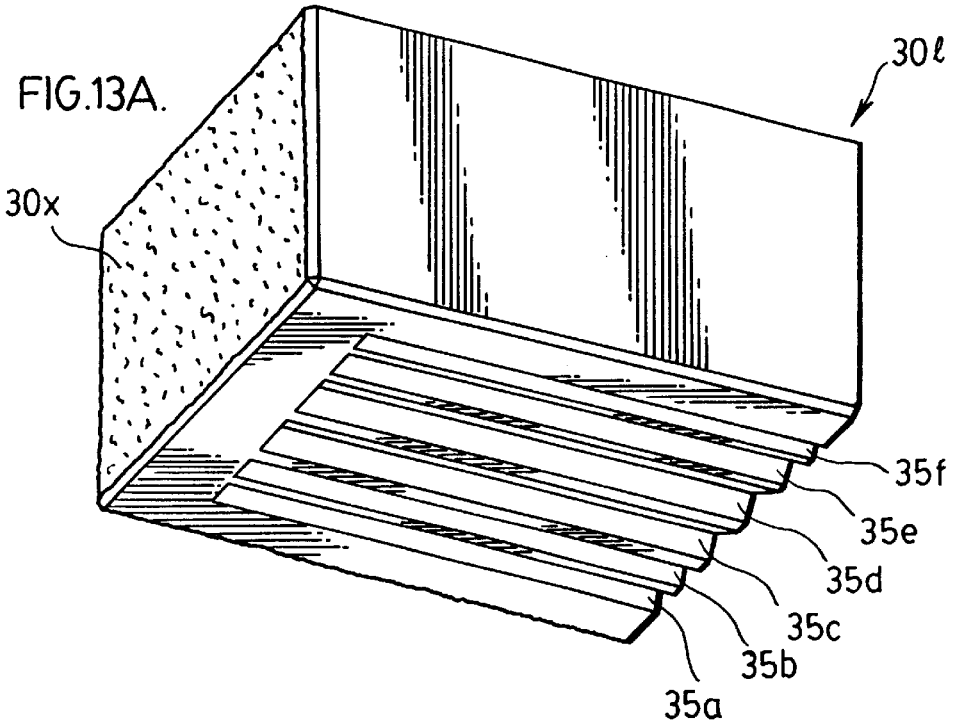

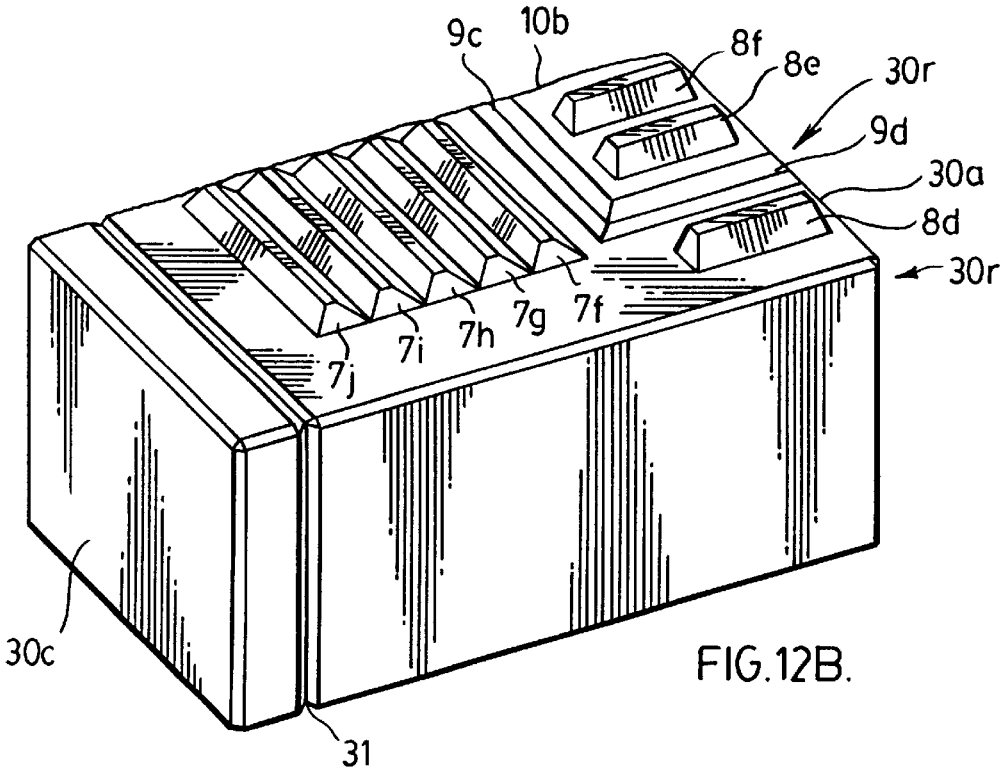
FIG.12B.
FIG.13B.
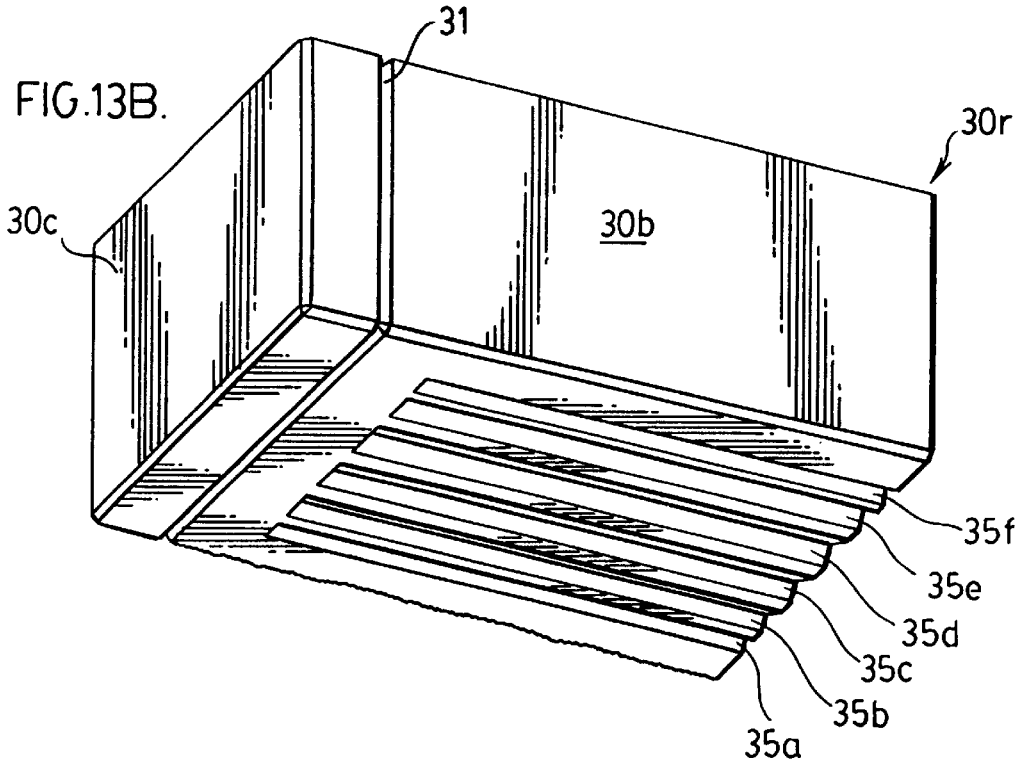

MORTARLESS RETAINING WALL STRUCTURE WITH IMPROVED LATERAL AND LONGITUDINAL REINFORCEMENT FOR A VERTICAL, SET FORWARD AND/OR SET BACK RETAINING WALL IN WHOLE OR IN PART CONSTRUCTED BY UTILIZING STANDARDIZED BLOCKS

TITLE OF THE INVENTION

A Mortarless Retaining Wall Structure with Improved Lateral and Longitudinal Reinforcement for a Vertical, Set Forward and/or Set Back Retaining Wall in Whole or in Part Constructed by utilizing Standardized Blocks. This Application is a division of 08/996,261 Dec. 22, 1997.

FIELD OF THE INVENTION

This invention relates to mortarless retaining wall constructions which may be vertical, set back in whole or in part with regard to the vertical, or set forward in whole or in part with regard to the vertical. Standardized block constructions are also provided which enable one to obtain the aforementioned retaining wall structures and combinations thereof. This invention finds particular application to a unique standardized block construction and a corner block construction as well as a wedge-shaped construction which allows the user to build retaining walls of various configurations as will be described hereinafter.

BACKGROUND OF THE INVENTION

Retaining walls are well known. These structures may be built including mortar, or as introduced more recently constructed from mortarless construction. The mortarless construction includes building blocks of predetermined design which may be stacked course upon course as a wall including a cap stone. Most blocks provided in the prior art are limited in the number of degrees of freedom that they provide the professional landscaper when constructing retaining walls. This invention obviates this limitation.

Many block constructions provide for only the ability of the contractor to build a set back retaining wall. Within a retaining wall system, it would be beneficial to be able to produce wall structures which are set back and or set forward in some portions thereof and vertical in other portions thereof. This is heretofore unknown. For example, when preparing a set of steps which traverse an incline, when blocks that provide only set back wall structures are provided, the length of the steps which traverse the incline will increase and diverge by necessity. That is to say, the lengths of each step will gradually increase as one moves up the incline course upon course. It would be advantageous to be able to provide a standard block which may not only be set back when appropriate, but which also may be stacked vertically when appropriate, such as when creating steps to traverse an incline to thereby not alter the step lengths since this may not always be desirable or esthetically pleasing.

Further, quite often, cribbing is provided to reinforce or tie back a retaining wall back into the incline around which the retaining wall is being built. Although this is desirable, it is not always cost effective. It would be desirable therefore to reduce the expense by providing a retaining wall which does not require the necessity of cribbing structures being assembled. There exists therefore a need for a simple, easy to use number of components which an installer may install course upon course to prepare a reasonable number of attractive options for the building owner without limiting the number of alternatives for which recommendations may be made by the landscaper.

Examples of the prior retaining wall structures and the blocks therefore may be found in the following patents.

U.S. Pat. No. 4,490,075 corresponding to Canadian Patent 1,182,295, and U.S. Pat. No. 4,815,897 corresponding to Canadian Patent 1,204,296 teach the use of a retaining wall system as best seen in FIG. 2 which includes a number of blocks formed into a cribbing as seen in FIG. 3 in order to provide lateral and longitudinal reinforcement of the cribbing as the wall is built. Such a construction is, needless to say, very expensive and at times unnecessary. Further, referring to FIG. 8, there is illustrated and described a block construction which includes an automatic offset when like blocks are stacked one upon the other. The only way for the block can be utilized for retaining walls is if the wall is set back from the vertical. The ability to build vertical walls using the same block is described in the claims of U.S. Pat. No. 4,815,897 wherein the blocks are reversed 180 degrees as the courses progress. The block does not include the provision of building a retaining wall which may be set forward from the vertical in whole or in part. Further unless a structure as seen in FIG. 2 is built including a massive amount of cribbing, there is no tying in of the blocks longitudinally. This severely limits the imagination of the landscaper when constructing a retaining wall. There therefore exists a need for an improvement to provide more esthetically pleasing retaining walls while using a standard lead configured block.

Canadian Patent 941,626 issued Feb. 12, 1974 to Risi describes a retaining wall system including projections and grooves which interfit. However, unlike the inventions which followed this patent, the projections and recesses are vertically in alignment as opposed to being offset with one another with respect to a vertical axis. In all cases, the projections and recesses fit. That is to say, there is no ability to stack the courses in any other manner than as provided for with the interfitting of the recesses with the projections.

U.S. Pat. No. 4,860,505 and the equivalent Canadian 1,307,675 to Bender describes a construction block which includes a multiplicity of recesses on the bottom thereof and at least two projections being provided on the top thereof. The distance from the face of the block to the first projection is at least equivalent to the distance from the face of the block to the second recess. These blocks may therefore be stacked course upon course only in a manner which is best seen in FIG. 5, that is the building of a set back or offset retaining wall. No provision is made within this structure to provide longitudinal reinforcement for adjacent blocks as the construction of the wall progresses.

U.S. Pat. No. 4,524,551 and the European equivalent, 59,820, to Rolf Scheiwiller describes a construction block and walls built therefrom as best seen in FIG. 2 of that patent which includes a number of projections provided on the top of the structure which interfit with the number of projections provided on the bottom of the structure. This may be seen readily in FIG. 5 and FIG. 6. It may be said that no flat surface is provided on the top or bottom of the blocks between the ends of the block used in constructing such a retaining wall. Further, the structure may or may not be advantageous to a landscaper in that a multitude of blocks of various shapes and sizes as best seen in FIG. 11 is necessary to provide various forms to the retaining wall structures. The blocks may be stacked set back, exemplified by FIG. 11 or alternatively as best seen in FIG. 17 in a vertical wall construction. Further the individual blocks may be set forward as seen in FIG. 15. Again, as with the prior structures, there is no description of longitudinal reinforcing of adjacent blocks when preparing a wall structure as blocks are stacked course upon course.

U.S. Pat. No. 5,031,376 to Eugene Bender, issued in 1991, describes a retaining wall construction and a block therefor as best seen in FIG. 4 which is initially manufactured in a two-block module including a pre-scored section at 20 to allow separation into two like block constructions which are mirror images. A projection and a groove at 15 and 35 are therefore provided which interfit.

U.S. Pat. No. 468,838 describes and illustrates a block with interfitting recesses and grooves of standard interfitting configurations. Italian Patent 548,936 also describes a building block including interfitting grooves and recesses.

U.S. Pat. No. 4,193,718 describes a retaining wall which includes a set back wall construction which is tied back to the earth as described and illustrated using a unique block construction. The only type of wall construction that may be built utilizing this block is a set back wall construction.

U.S. Pat. No. 4,229,123 describes a hollow block as seen in FIG. 3 which may be formed into an inclined retaining wall as described. A forward projection at 4 as seen in FIG. 7 is provided to provide the interfitting of the blocks. These blocks may be advanced with regard to one another as seen in FIG. 3.

Australian Patent Application 17231/83 illustrates and describes a block construction as seen in FIG. 1 for building a retaining wall having a set back configuration only. Nothing is described in relation to the retaining wall that provides for tying in of adjacent blocks.

Canadian Patent 1,188,116 describes at FIG. 6 a set back retaining wall construction as does U.S. Pat. No. 4,671,706.

West German Patent Application 3,014,318 describes a block construction for the preparation of walls, steps or the like as best seen in the Figures including offset ridges and grooves which interfit in a horizontal or vertical manner as seen in FIG. 5 to present various uses for the block. Nowhere is there described in this teaching of the longitudinal reinforcement of adjacent blocks.

French Patent 957,860 describes a block wherein the ridges are i n vertical alignment with one another. The blocks are hollow and are manufactured in double-block modules being mirror imaged halves.

Great Britain Patent Specification 536,434 describes a building block having projections of alternative configuration as seen in FIG. 1 and FIG. 2 wherein alternative wall constructions may be formed. The block is hollow as well.

U.S. Pat. No. 2,094,167 to Evers, issued in 1936, provides for a retaining wall which is inclined to the vertical, although not set back when stacking course upon course, and includes blocks of various lengths as seen in FIG. 4 which provides for longitudinal and lateral interlocking of adjacent blocks through the cribbing structure therefor provided. However, there is no direct interlocking of adjacent blocks other than through such a cribbing structure.

Canadian Patent 1,237,288 to Crinnion describes, as best seen in FIGS. 11, 12 and 13, various forms of retaining walls formed by a block construction which may be set back in part, set forward in part, but never vertical in terms of wall constructions.

Canadian Patent 1,293,868 to Transpave Inc. describes, as seen in FIG. 6, various wall forms which may be manufactured from providing a unique block construction seen in FIG. 2 and in FIG. 3, provides for the advancing of sections of the wall. The same block therefore clearly is not being utilized when manufacturing such wall structures as seen in FIG. 5 which clearly sets out that a specific block 50 interfits within the pocket provided within the block 25.

Great Britain Patent 1,386,088 describes various forms of blocks which may be arranged in forming walls including a matrix of reinforcements as seen in FIG. 12 which interfit with like reinforcements to provide retaining wall constructions. Further, as seen in FIGS. 32 and 33, a unique block arrangement may be provided which describe a half-corner block. Corner blocks will be described hereinafter. In that regard, the reader is referred to this patent specification as well.

Canadian Patent Application 2,115,462 to Ciccarello describes a unique anchoring system for a block for a retaining wall including a longitudinal groove in the top face wherein a hook is adapted for engaging.

U.S. Pat. No. 3,422,588 describes another type of interfitting building block which interlocks with grooves and projections. Similarly, U.S. Pat. No. 2,703,487 shows many forms of grooves and projections which may be provided which interfit.

West German Patent Application 2,947,653 published in 1981 and as best seen in the Figures, and specifically FIGS. 7 and 12, provides for blocks which interfit via pockets and projections which may be angled with respect to one another when required.

U.S. Pat. No. 4,671,039 describes a hollow block including a number of interfitting vertically aligned or horizontally aligned grooves and ridges as best seen in FIG. 6 which interfit to provide the retaining wall structure.

U.S. Pat. No. 4,512,685 describes a building block construction of unusual configuration for the formation of various wall forms seen in FIGS. 7, 8 and 9 which may be vertically disposed, or alternatively, as seen in FIGS. 10, 11 and 12 which are set back from the vertical. Such retaining walls provided therefor must include a variety of block sizes in order to construct the examples shown in the patent.

U.S. Pat. No. 2,313,363 describes a retaining wall and block used for forming the same which retaining wall is set back as a result of the block construction. No other possibility is provided. Different faces, however, are provided for the blocks as seen in FIGS. 5 and 6. Many of the various blocks previously described, and specifically U.S. Pat. No. 4,524,551, among others, are formed with mirror image blocks formed as a module back to back which are split along a pre-formed splitting groove. The face therefore provided by the splitting groove may be considered to be a rough, cut or split face throughout this specification. This split face presents one which has the appearance of rough stone as opposed to a smooth face which is pre-formed. This, again, is seen in the patent to Bender, U.S. Pat. No. 5,031,376. The opportunity therefore exists to provide a stone which may be formed as a module or mirror image stones formed back to back to provide various faces which may be exposed to the exterior of the wall and be viewed, that is to say a smooth face or a rough split face. This would be desirable regardless of the type of wall being built, and whether the wall includes other features such as pillars, stairs or the like.

Canadian Industrial Design 58,391 issued in 1987 to Risi Stone Inc. describes a building block having projections which interfit exactly together with a large recess provided on the bottom of the stone.

French Patent 1,192,074 describes a building block which interfits utilizing offset projections and recesses.

U.S. Pat. No. 3,643,392 also teaches such a similar construction having a hollow interior and utilized as a building block.

German Patent 3,029,494 describes a hollow construction member which in various wall forms as seen in FIGS. 7, 11 and 5, results from interlocking appendages at 7 and edges as best seen in FIG. 14.

Canadian Industrial Design 64,161 to Risi Stone Inc. describes an interfitting building block with an angled face which may be removed if desired via the predefined cutting of the shaped groove to expose a rough or split face. Canadian Industrial Design 57,926 also to Risi Stone Inc. describes a capping stone as best seen in the Figures. Canadian Industrial Design 58,080 to Risi Stone Inc. describes a stone similar to that previously described wherein only one ridge is provided on the stone or alternatively two ridges may be provided as seen in FIG. 1B. Canadian Industrial Design 51,313 to Risi Stone Inc. describes an interfitting building block having offset ridges and grooves. Canadian Industrial Design 51,160 to Risi Stone Inc. describes a cribbing having alternating offset recesses and grooves.

U.S. Pat. No. 5,064,313 to Risi Stone Inc. describes a reinforcing structure for an embankment used in conjunction with his stone as seen in FIG. 4 for tying back the wall so formed into the hill being landscaped. The tie back is accomplished as best seen in FIG. 6 via the netting 60 tied back to a pin 92 fitting within an opening 90 within the block. U.S. Pat. No. 4,824,293 describes another type of joint for reinforcing a wall back into a hill.

The above-mentioned references discuss blocks having various configurations of ridges and interfitting grooves. These examples are not exhaustive but exemplify the most well known systems available today for producing retaining walls. None of the systems are simple to use. None of the systems offer the number of degrees of freedom to a landscaper which allows for individual designs of the retaining wall. It would therefore be advantageous to provide a building block to allow for such individualistic designs to be obtained. Further, it would be advantageous to provide a building block which is not limited in the manner in which it may be stacked upon a previous course by the precise interfitting of projections and grooves. Such interfitting also provides for resistance to sheer in a horizontal direction. The need therefore exists to increase the surface area to which the sheer load may be distributed.

When constructing a retaining wall, it is well known that corners are unavoidable. In providing a corner, it is often necessary to provide a unique block construction. Examples of such constructions may be found in the prior structures.

U.S. Pat. No. 3,534,518 illustrates in FIG. 4 a corner block which may be utilized as seen in FIGS. 3 and 4. This block allows for interfitting with other blocks including the projections illustrated. U.S. Pat. No. 1,639,063 illustrates in FIG. 3 another corner block construction for a wall. U.S. Pat. No. 2,668,435 illustrates in FIGS. 11 and 12 and the description related thereto a corner block construction.

U.S. Pat. No. 4,107,894 describes a hollow block which interfits using appendages at 30 correlating to hollows at 44 for forming a wall construction.

Canadian Patent 181,035 also teaches a corner block as seen in FIG. 4 therein. U.S. Pat. No. 5,160,212 describes a corner joint for a building unit substantially as illustrated.

Wedge shaped blocks are also well known. Canadian Industrial Design 45,982 to Ibstock Building Products Limited illustrates a typical wedge-shaped building block. Similar subject matter is found in Canadian Industrial Design 47,747 to Scheiwiller and Canadian Industrial Design 50,020 to the same inventor for wedge-shaped building blocks. It would be advantageous to incorporate into the design of a standard configuration for blocks a wedge-shaped building block having all of the benifits of the standard block.

Canadian Industrial Design 71,472 to Kiltie Corporation describes a wedge-shaped block as best seen in the Figures.

U.S. Pat. No. 5,252,017 describes a retaining wall including generally wedge-shaped blocks which may be tied into one another and stacked in only a set-back configuration because of the unique set-back pin construction as best seen in the Figures, and specifically FIG. 8. A wedge-shaped construction block is also provided in this regard including a rough face as seen in FIG. 14 or a smooth face at FIG. 14 being surface 42.

French Patent 2,597,132 describes a number of individual trapezoidal-shaped members seen in FIG. 1 to interlock like blocks one above the other and act as stops as seen in FIGS. 3 and 4.

Other types of retaining wall structures which have been known in the prior literature include supplementary members which are used to tie in or interconnect building blocks. Examples of such retaining wall structures follow.

German Patent Application 2,348,043 published in 1974 describes a retaining wall as seen in FIGS. 13 or 10 which includes an opening within the tops and bottoms of the block within which a peg is inserted to interconnect the inferior and superior course blocks.

German Patent Application 4,333,942 describes a retaining wall system for plant blocks which includes as best seen in FIG. 4 a groove in the top and the bottom of the blocks which interfit and contain a reinforcing rectangular member at 21 as best seen in FIG. 4. European Patent 21,449 published in 1980 describes as best seen in FIG. 3 a building block which includes recesses only on the top of walls which walls are angled one to another and contain therein members 17 which extend past the ends of the blocks. However, there is no recess disposed at the bottom of the block to tie in course upon course to resist horizontal shear forces and to tie in adjacent blocks with one another.

West German Publication 2,755,833 describe as best seen in FIGS. 6 and 7 the use of interconnecting members 5 which interfit within recesses upon the top and bottom of blocks. However, the blocks do not provide interfitting recesses and appendages in combination with the block to improve the load-carrying ability of the block laterally and longitudinally.

U.S. Pat. No. 4,319,440 describes a building block which has hollow configurations and, as best seen in FIG. 6, may include interfitting angled reinforcing portions.

U.S. Pat. No. 5,282,700 to Transpave Inc. along with Canadian Industrial Design 71,456 and 71,457 describe interlocking blocks which include offset key members for utilization for interconnecting these blocks as best seen in FIG. 16 of the patent. The key has a unique shape which is not easily manufactured. Further, these blocks can only be stacked in an offset condition.

U.S. Pat. No. 5,248,226 to Risi describes a unique key arrangement as seen in FIGS. 2, 5 or 4 which interfit in like grooves and ridges to advance a wall block as seen in FIG. 11 or set it back as seen in FIG. 10 with a very unique type and somewhat complicated key construction.

Canadian Patent 2,114,677 describes and illustrates a key and block arrangement for assembling a retaining wall structure as best seen in FIGS. 5A and 5B. The key may be as seen in FIG. 1.

Nowhere within the prior art is there found a standardized block construction having provided therewith the ability to form a retaining wall in whole or in part being substantially vertical, being substantially off set to the vertical, and being substantially set forward to the vertical. In this regard, there is a need for a standardized block which includes provision for the at least three positions required in order to form the aforementioned retaining walls. These blocks may be of any configuration.

Further, nowhere within the prior art is there found a standardized block construction which is manufactured to provide either a smooth face at both exposed faces, a smooth face and a rough split face for both exposed faces, or two rough or split faces for both of the exposed faces of the block. Such a structure would provide the landscaper with a much improved ability to form esthetically-pleasing wall systems. This is heretofore unknown as being provided with a standardized block construction.

Further, nowhere within the prior art is there found a standardized corner which may be utilized as a left-hand corner or a right-hand corner simply by reversing or flipping the block.

All of the aforementioned needs are therefore met by the present invention.

It is therefore a primary object of the invention to provide a standardized block construction which includes the ability to expose a smooth and/or a rough face at both faces of the block.

It is a further object of the invention to provide a standardized building block which may be utilized as a double block or a single block in the various wall configurations possible.

It is yet a further object of the invention to provide a standardized block for retaining wall systems which include the necessary features to allow for in whole or in part setting course upon course in substantially vertical alignment, in set back alignment to the vertical, in set forward alignment to the vertical, or any combination thereof in a retaining wall system without limitation.

It is a further object of the invention to provide a standardized block construction which, in combination with the features of the block improves both the lateral stability of the block and the longitudinal stability of the block when it is placed course upon course to form a retaining wall.

It is yet a further object of the invention to provide a standardized block construction for a corner block which may be utilized as either a left-hand or a right-hand corner block.

It is yet a further object of the invention to provide a substantially wedge-shaped block having all of the aforementioned features of the standardized block.

It is yet a further object of the invention to provide a retaining wall formed from standardized blocks which in whole or in part may be inclined to the vertical or which may be substantially vertical.

It is yet a further object of the invention to provide a retaining wall system including the standardized block, the corner block, and/or the substantially wedge-shaped block, which provides when stacked course upon course with one another, and esthetically pleasing retaining wall system.

Further and other objects of the invention will become apparent to those skilled in the art when considering the following summary of the invention and the more detailed description of the preferred embodiments illustrated herein.

SUMMARY OF THE INVENTION

According to one aspect of the invention, there is provided a standardized block for forming a retaining wall, said block comprising a top and bottom and having disposed proximate the top thereof first, second and third abutment means, and having disposed proximate the bottom thereof fourth, fifth and sixth abutment means, said second and fifth abutment means abutting in a first abutting position when like blocks are placed course upon course to form a retaining wall having a substantially vertical alignment, said first abutment, said second abutment and said third abutment abutting with said fourth, fifth and sixth abutment in a second abutting position different from said first position when like blocks are placed one upon the other, course upon course, to provide a substantially set-back retaining wall construction, and wherein said first, second and third abutment means abut with said fourth, fifth and sixth abutment means in a third abutting position different from said second or first position when like blocks are placed one upon another, course upon course, to provide a substantially set forward retaining wall construction, wherein said block may be utilized by an installer to construct in whole or in part a substantially vertical retaining wall, a substantially set back retaining wall from the vertical, and a substantially set forward retaining wall from the vertical utilizing the same block and any combinations thereof when forming a retaining wall. In a preferred embodiment, the top and bottom of said blocks may further comprise means for engaging the block with an adjacent like block to improve the longitudinal stability of the retaining wall being formed. Preferably said means for improving the longitudinal stability of the wall being a combination of key receiving key ways and supplementary keys disposed in the top and bottom of said block in use. Preferably said first, second, third, fourth, fifth and sixth abutments being may further comprise a combination of grooves and projections which interrelate as like blocks are placed one upon another course upon course when forming retaining walls.

The block of the present invention is not limited by shape. The block may take various shapes and forms including a rectangular, square, wedge-shaped, circular, oval, and any other shape desired by the landscaper. The standardized block construction may be used in forming a retaining wall system in combination with a corner block, said corner block including a top and bottom and having disposed proximate the top and bottom a predetermined number of grooves on both said top and bottom which may engage with one or more of the first, second, third, fourth, fifth and sixth abutment means of said block when a retaining wall is formed. In one embodiment, said corner block may be formed to include grooves extending in two directions to tie in with adjacent blocks utilizing supplementary keys provided to assemble the retaining wall. In another embodiment, a provision for the grooves is provided with the bottom and top of said corner block, and one of the grooves is extended by the installer during installation.

It is important to note that the installer plays a very important role in constructing the retaining wall. That is to say that there is no automatic provision when placing course upon course for a predisposition of the blocks. The blocks must be set or placed at the desired one of three positions as described above when forming a retaining wall. This is unlike the prior art in that specifically the Risi teachings refer to automatic offsetting of the retaining wall when his grooves and ridges interfit. Risi does provide for the reversing of the block, that is to say reversing of the faces of the block, when forming a retaining wall to allow for the substantial vertical forming of the retaining wall. The present invention, however, does not require for the excessive manhandling of the blocks required such as when blocks are reversed. The installer merely needs to position and place the block in its desired position with the abutments in the first, second and/or third positions and combinations thereof. This is heretofore unknown. The blocks may be formed by any known molding process or block forming process. Preferably, said blocks are hollow to improve the handling ability of the block. Many colours may be utilized, for example, granite or limestone colours may be utilized to provide an esthetically pleasing retaining wall. Typically the keys utilized with the retaining wall may be preferably hollow and formed from a plastic, nylon or other flexible material in an extruded rodlike form which may be cut off as desired by the installer. Further, said keys may be formed to be in one piece and providing substantially a right-angled key, including two elements extending substantially 90° to one another.

According to yet another aspect of the invention, there is provided a block construction for forming a retaining wall, said block comprising a top and a bottom and having disposed proximate the top a plurality of projections, and a plurality of key ways, said block having disposed proximate the bottom thereof a plurality of grooves and/or a plurality of keyways, said keyways for receiving keys in use, wherein when a retaining wall is formed from said standard block, the projections engage with said recesses to provide resistance to shear laterally in relation to the block when stacked course upon course, and wherein the insertion of keys in the key ways in use when a retaining wall is formed and blocks are stacked course upon course provides interconnection of adjacent like blocks on the same course and thereby improves the longitudinal strength of the retaining wall, said block in use providing both lateral and longitudinal reinforcements. In a preferred embodiment, said standardized block may be constructed with projections disposed on the top thereof and recesses disposed on the bottom thereof wherein the addition of the key-receiving key ways adds to the ability of the block to be formed into retaining walls which improves the longitudinal stability of the retaining wall so formed by tying adjacent blocks together as a course is stacked upon course. In another embodiment, the block only includes one projection and one recess flanked by the key-receiving key ways disposed one on each side of the recess and the projection. In this manner, adjacent blocks may be tied in longitudinally with respect to one another as course is stacked upon course when forming the retaining wall.

According to yet another aspect of the invention, there is provided a standard block utilized to form a mortarless retaining wall, said block comprising a top and a bottom, two sides and two exposed faces proximate ends of said block, said top of said block having disposed therewith two centrally-disposed projections separated by a space, said space being disposed proximate the center of said block, said top of said block having provided therewith a third and a fourth projection each being spaced toward the faces of said block from said two centrally disposed projections, said two centrally disposed projections and each of said third and fourth projection having disposed there between a second space, the top of the block proximate said second spaces each having provided therewith a first and second key-receiving key way disposed between the two centrally disposed projections and each of said third and fourth projections, the bottom of said block having disposed therewith a centrally disposed recess having a dimension slightly greater than the distance between the distal edges of said two centrally disposed projections, said first recess including a key-receiving key way extending from the bottom of the block, said bottom of said block having disposed therewith and spaced from the centrally disposed recess a pair of recesses each bounded by a first leading and second lagging abutment, and third leading and fourth lagging abutment and for selective engagement respectively with the second and third projection disposed with the top of like blocks, the pair of recesses having disposed therewith a key-receiving key way extending from the bottom of the block, preferably said projections, key-receiving key ways and recesses extending preferably, substantially from side to side of said block, and in another embodiment only in part from side to side of said block (for example, when the block is formed in a wedge shape the projections may be discrete projections extending between the sides of said blocks with said recesses and said key-receiving key ways extending substantially the full side to side dimension of said blocks), the centrally disposed recess and each recess flanking the centrally-disposed recess having disposed there between a portion of the bottom of the block also acting as an abutment, wherein when the block is placed course upon course with like blocks to form a retaining wall, the installer may manually place the blocks course upon course with the pair of centrally-disposed projections substantially fitting within the centrally-disposed recess of a superior course of like blocks to thereby provide a first mode within which the blocks may be stacked and thereby forming a substantially vertical retaining wall, wherein the installer may manually place the blocks course upon course so that the space between the centrally disposed projections interfits with the portion of the bottom of the block between said centrally-disposed recess and the first recess and simultaneously, a leading edge of said projections spaced from said pair of centrally-disposed projections abuts with the leading abutments of said pair of recesses flanking said centrally-disposed recess proximate the bottom of said block, and thereby providing resistance to a horizontal shear force applied upon the blocks when the retaining wall is constructed, whereat at the second mode for installation of said blocks when placed course upon course for forming a retaining wall, a substantially uniformly set back retaining wall is constructed, wherein an installer may place like blocks course upon course in a third configuration wherein the space between the two centrally-disposed projections interfits with the portion of the bottom of the block disposed between the centrally disposed recess and the second recess whereat simultaneously a lagging edge of said projections spaced from said pair of centrally-disposed projections abuts the lagging abutment walls of said recesses of said block, whereat the installer when placing blocks course upon course in forming a retaining wall will form in a third mode of installation a substantially set forward retaining wall to the vertical, preferably said key-receiving key ways having installed therewith when like blocks are placed one upon another, course upon course, keys for tying in adjacent blocks and providing longitudinal reinforcement of the retaining wall, wherein the installer may form a wall in three modes in whole or in part using the standard block, namely a substantially, vertically disposed retaining wall, a substantially set back retaining wall from the vertical, and/or a substantially set forward retaining wall from the vertical, or any combination of courses exemplifying the available modes thereof. In a preferred embodiment, a first course may extend from a second inferior course in a substantially vertical relation, whereat a third course may extend from said second course in a substantially set-back relation for the vertical courses of the wall being constructed and wherein a fourth course may extend substantially as a set forward course in relation to the vertical for the wall being formed. In a preferred embodiment, the standardized block may be hollow. Although it is preferred to include the key-receiving key ways proximate the top and bottom of the block as predefined above, it is not absolutely essentially to do so in all embodiments of the block. However, in leaving out the key ways, the various forms of the retaining walls may be provided, however, without longitudinal tying in of adjacent blocks to one another. Typically, the blocks are of constant cross section near the faces thereof but are not of constant cross section from the first and second recesses of the block structure inward. The third and fourth projections do not interfit with the second and third recesses of the block. It is important that the leading and lagging edges of the projections engage the leading and lagging abutment walls of the recesses, so that there is simultaneous resistance to horizontal shearing forces at each of the projections and abutment walls thereby providing a greater surface area to resist such horizontal shearing force.

In a preferred embodiment, any of the aforementioned blocks may be constructed in a dual-block module, that is to say, each module includes two blocks joined together proximate one face thereof and comprising substantial mirror images of one another, each block having disposed proximate the opposite faces which are not joined a removable section to present either a smooth face for the block when the removable section is retained, or a rough split face for the block when the removable section is removed, preferably the block including a scoreline prior to the removable section to enable an installer to remove that section as required.

According to yet another aspect of the invention, there is provided a module for a block comprising two blocks formed face to face including a scoreline to enable an installer to split the mirror image blocks and separate them one from another, each block having disposed proximate its other face a removable section separated from the block by a scoreline to enable removing of that section, said removable section providing a smooth face for the other face of the block when the removable section is not removed, and a rough split face for the block when the removable section is removed. In a preferred embodiment, the aforementioned block may further comprise all of the limitations of the inventions previously described.

According to yet another aspect of the invention, the aforementioned block module may further comprise a corner block joined at the side edges thereof and including two mirror image blocks joined at said edge, each of said blocks having a pair of exposed faces, at least one of said faces including a removable portion separated from said block by a scoreline so as to allow an installer to remove said removable portion, wherein said corner block may present a pair of smooth faces when exposed, or alternatively a smooth and a rough split face as exposed. Preferably, each of said blocks including key-receiving key ways disposed proximate the top and bottom thereof. In another embodiment, said key-receiving key ways extend between the faces of said blocks joined at 90° to key ways extending from side to side of said blocks. In a preferred embodiment, the second key ways are only provided in part being completed by an installer during the installation of a retaining wall system. In another embodiment, discrete recesses and projections may extend from the top and/or bottom of said corner blocks which engage with like discrete recesses and projections when stacked course upon course. In a preferred embodiment, said corner blocks have the above-mentioned features of key-receiving key ways provided on both the top and the bottom of said corner block.

According to yet another aspect of the invention, there is provided a corner block for interfitting with a standard block, said standard block including projections provided proximate the top thereof and recesses provided proximate the bottom thereof, preferably as described in the aforementioned embodiments of the invention in the several paragraphs preceding this paragraph, and also including key-receiving key ways, said corner block comprising a quadrilateral-shaped member, and preferably rectangular, having a top and bottom, two sides and two exposed faces, said corner block having disposed proximate the top thereof a number of key-receiving recesses extending between the faces of said corner block and having disposed proximate one end of said key-receiving key ways at least in part the provision for key-receiving key ways extending laterally toward the sides of the block and preferably joining the other key receiving recesses, each of said key ways for receiving keys which keys in use extend past the sides and faces of said block to tie into the adjacent standard blocks and interconnect the retaining wall so formed with the corners when stacking course upon course. Preferably said corner blocks including key-receiving recesses disposed proximate the bottom thereof for interfitting with like courses as the retaining wall is built. In another embodiment, the top and/or bottoms of the corner block may further comprise discrete recesses and projections which are mirror images of one another so as to provide for the interfitting of the blocks and enhance the ability of the corner block to resist horizontal sheer forces, preferably said interfitting being substantially when a left-corner block is stacked upon a like left-corner block when the bottom of the block includes only key-receiving key ways or alternatively with a like block set at 90° to the original plane of extension of the first block to enable the recesses and pockets to align so as to interfit when a left-hand block is inverted upon a right-hand block and turned at 90° to the extension of the right-hand block. A retaining wall may therefore be so formed. In this regard, the corner and the standard block together when formed into a course for a retaining wall provide both lateral and longitudinal resistance to loads applied on the retaining wall.

According to yet another aspect of the invention, there is provided a first and a second building blocks capable of being assembled with one another to form a retaining wall structure without requiring mortar or similar binders, said retaining wall comprising a first and a second block being assembled in a predetermined manner course upon course so as to form said retaining wall, said first block comprising a top and a bottom, two sides and two exposed faces proximate ends of said block, said top of said block having disposed therewith two centrally-disposed projections separated by a space, said space being disposed proximate the center of said block, said top of said block having provided therewith a third and a fourth projection each being spaced toward the faces of said block from said two centrally disposed projections, said two centrally disposed projections and each of said third and fourth projection having disposed there between a second space, the top of the block proximate said second spaces each having provided therewith a first and second key-receiving key way disposed between the two centrally disposed projections and each of said third and fourth projections, the bottom of said block having disposed therewith a centrally disposed recess having a dimension slightly greater than the distance between the distal edges of said two centrally disposed projections, said first recess including a key-receiving key way extending from the bottom of the block, said bottom of said block having disposed therewith and spaced from the centrally disposed recess a pair of recesses each bounded by a first leading and second lagging abutment, and third leading and fourth lagging abutment and for selective engagement respectively with the second and third projection disposed with the top of said block, the pair of recesses having disposed therewith a key-receiving key way extending from the bottom of the block, preferably said projections, key-receiving key ways and recesses extending preferably, substantially from side to side of said block, and in another embodiment only in part from side to side of said block (for example, when the block is formed in a wedge shape the projections may be discrete projections extending between the sides of said blocks with said recesses and said key-receiving key ways extending substantially the full side to side dimension of said blocks), the centrally disposed recess and each recess flanking the centrally-disposed recess having disposed there between a portion of the bottom of the block also acting as an abutment, wherein when the block is placed course upon course with like blocks to form a retaining wall, the installer may manually place the blocks course upon course with the pair of centrally-disposed projections substantially fitting within the centrally-disposed recess of a superior course of like blocks to thereby provide a first mode within which the blocks may be stacked and thereby forming a substantially vertical retaining wall, wherein the installer may manually place the blocks course upon course so that the space between the centrally disposed projections interfits with the portion of the bottom of the block between said centrally-disposed recess and the first recess and simultaneously, a leading edge of said projections spaced from said pair of centrally-disposed projections abuts with the leading abutments of said pair of recesses flanking said centrally-disposed recess proximate the bottom of said block, and thereby providing resistance to a horizontal shear force applied upon the blocks when the retaining wall is constructed, whereat at the second mode for installation of said blocks when placed course upon course for forming a retaining wall, a substantially uniformly set back retaining wall is constructed, wherein an installer may place like blocks course upon course in a third configuration wherein the space between the two centrally-disposed projections interfits with the portion of the bottom of the block disposed between the centrally disposed recess and the second recess whereat simultaneously a lagging edge of said projections spaced from said pair of centrally-disposed projections abuts the lagging abutment walls of said recesses of said block, whereat the installer when placing blocks course upon course in forming a retaining wall will form in a third mode of installation a substantially set forward retaining wall to the vertical, preferably said key-receiving key ways having installed therewith when like blocks are upon another, course upon course, keys for tying in adjacent blocks and providing longitudinal reinforcement of the retaining wall, wherein the installer may form a wall in three modes in whole or in part using the standard block, namely a substantially, vertically disposed retaining wall, a substantially set back retaining wall from the vertical, and/or a substantially set forward retaining wall from the vertical, or any combination of courses exemplifying the available modes thereof, a said second block being corner block comprising a quadrilateral-shaped member, and preferably rectangular, having a top and bottom, two sides and two exposed faces, said corner block having disposed proximate the top thereof a number of key-receiving recesses extending between the faces of said corner block and having disposed proximate one end of said key-receiving key ways at least in part the provision for key-receiving key ways extending laterally toward the sides of the block and preferably joining the other key receiving recesses, each of said key ways for receiving keys which keys in use extend past the sides and faces of said block to tie into the adjacent standard blocks and interconnect the retaining wall so formed with the corners when stacking course upon course, wherein said first and second blocks when stacked course upon course in a retaining wall provide for the lateral and longitudinal resistance to loads of the retaining wall as adjacent blocks are tied into one another and to said second blocks. As the first and second blocks are stacked in superimposed horizontal courses row after row, the key-receiving key ways with the keys disposed therein allow for the longitudinal reinforcement of the retaining wall since the keys may be of any determined length to tie in adjacent first blocks and to tie the corner block to adjacent blocks via a special right-hand angled one-piece key.

According to yet another aspect of the invention, there is provided a first and a second building block capable of being assembled with one another to form a retaining wall structure without requiring mortar or similar binders, said retaining wall comprising a first and a second block being assembled in a predetermined manner course upon course so as to form said retaining wall, said first block comprising a top and bottom and having disposed proximate the top thereof first, second and third abutment means, and having disposed proximate the bottom thereof fourth, fifth and sixth abutment means, said second and fifth abutment means abutting in a first abutting position when like blocks are placed course upon course to form a retaining wall having a substantially vertical alignment, said first abutment, said second abutment and said third abutment abutting with said fourth, fifth and sixth abutment in a second abutting position different from said first position when like blocks are placed one upon the other, course upon course, to provide a substantially set-back retaining wall construction, and wherein said first, second and third abutment means abut with said fourth, fifth and sixth abutment means in a third abutting position different from said second or first position when like blocks are placed one upon another, course upon course, to provide a substantially set forward retaining wall construction, wherein said block may be utilized by an installer to construct in whole or in part a substantially vertical retaining wall, a substantially set back retaining wall from the vertical, and a substantially set forward retaining wall from the vertical utilizing the same block and any combinations thereof when forming a retaining wall, said second block being corner block comprising a top and bottom and having disposed proximate the top and bottom a predetermined number of grooves on both said top and bottom which may engage with one or more abutment means of another block stacked in an inferior or superior course when a retaining wall is formed said corner block said block including grooves extending in two directions proximate the top and/or bottom thereof to tie in with adjacent blocks utilizing supplementary keys provided to assemble the retaining wall with at least one of the grooves being extendible by an installer during installation, wherein said first and second blocks when stacked course upon course in a retaining wall provide for the lateral and longitudinal resistance to loads of the retaining wall as adjacent blocks are tied into one another and to said second blocks. As the first and second blocks are stacked in superimposed horizontal courses row after row, the key-receiving key ways with the keys disposed therein allow for the longitudinal reinforcement of the retaining wall since the keys may be of any determined length to tie in adjacent first blocks and to tie the corner block to adjacent blocks via a special right-hand angled one-piece key.

According to yet another aspect of the invention, there is provided a cap stone for the aforementioned block and retaining walls constructed therefrom, said cap stone comprising a top and a bottom and presenting a smooth top without any projections or recesses and having disposed proximate the bottom thereof a plurality of recesses so as to engage with the projections of the standard block and the key receiving key ways of the corner block, and further to act as key-receiving key ways to provide longitudinal reinforcement of adjacent cap stones within an inferior course of blocks.

According to any of the aspects of the invention described in any of the aforementioned paragraphs there is provided a standardized block construction which is manufactured to provide either a smooth face at both exposed faces, a smooth face and a rough split face for both exposed faces, or two rough or split faces for both of the exposed faces of the block. Such a structure provides the landscaper with a much improved ability to form esthetically-pleasing wall systems. Any of the aforementioned standardized building blocks may be utilized as a double block or a single block in the various wall configurations possible.

According to yet another aspect of the invention there is provided a corner block comprising a top and bottom and having disposed proximate the top and bottom a predetermined number of grooves on both said top and bottom which may engage with one or more abutment means of another block stacked in an inferior or superior course when a retaining wall is formed said corner block said block including grooves extending in two directions proximate the top and/or bottom thereof to tie in with adjacent blocks utilizing supplementary keys provided to assemble the retaining wall with at least one of the grooves being extendible by an installer during installation.

According to a final aspect of the invention, there is provided a method of constructing a retaining wall from like blocks, said blocks having a top and bottom and having disposed proximate said top and bottom at least one ridge and groove preferably having abutting surfaces and a predetermined number of key-receiving keyways adjacent the recesses and grooves respectfully, said blocks for constructing a retaining wall of the desired mode, said method comprising:

(a) preparing a base upon which the blocks are to be placed;

(b) placing a first block upon said base;

(c) placing a second block adjacent the first block and finishing the first course in like manner ensuring some of the key-receiving keyways are longitudinally in line from block to adjacent block;

(d) placing a key in at least some of the key-receiving keyways so as to extend from block to block longitudinally;

(e) placing a superior course in the desired mode of construction so as to ensure the ridges and grooves of the like blocks interrelate and that the keys of the key-receiving recesses disposed on the inferior courses engage the key-receiving keyways of the superior courses interrelate via the key so as to provide longitudinal stability to the retaining wall structure, wherein the ridges and grooves and the key-receiving recesses cooperate when the keys are positioned therein to provide both lateral and longitudinal stability to the retaining wall constructed by tying in adjacent like blocks to one another and by tying in a superior and inferior horizontal course to one another enabling the installer to construct walls of various modes in whole or in part, including said modes including walls substantially set back from the vertical and/or substantially vertical, and/or substantially set forward from the vertical and any combinations thereof.

BRIEF DESCRIPTION OF THE DRAWINGS

FIG. 5 is a side view of two courses of the standard block illustrating a superior course in relation to an inferior course set forward from the vertical and illustrated in a preferred embodiment of the invention.

FIG. 6 is a view similar to that of FIG. 5 illustrating a superior course upon an inferior course set back from the vertical and illustrated in a preferred embodiment of the invention.

FIGS. 9, 9A and 9B are top perspective views of corner blocks illustrated in preferred embodiments of the invention.

FIGS. 10, 10A and 10B are bottom perspective views of blocks of FIGS. 9, 9A, and 9B illustrated in preferred embodiments of the invention.

FIGS. 12, 12A and 12B are a top perspective views of corner blocks illustrated in preferred embodiments of the invention.

FIGS. 13, 13A and 13B are bottom perspective views of blocks of FIG. 12.

DETAILED DESCRIPTION OF THE PREFERRED EMBODIMENTS

Figure 19:
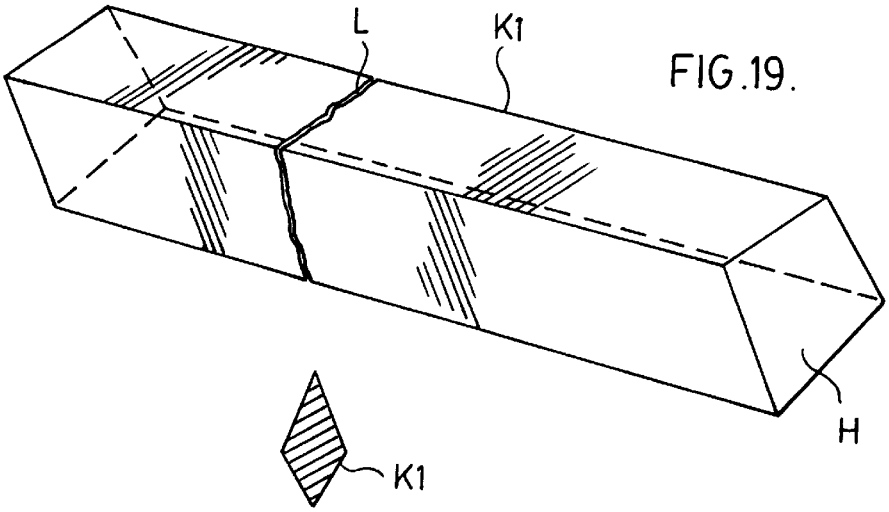
FIGS. 19 and 19A are hollow extruded keys to be utilized when constructing a retaining wall and illustrated in preferred embodiments of the invention.
Figure 19A:
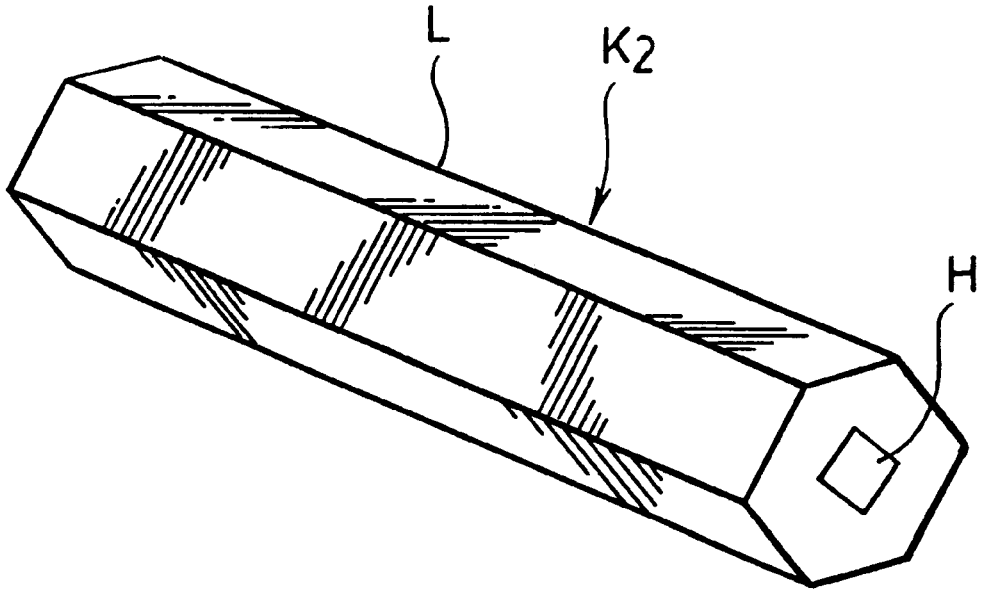

Referring now to FIGS. 1 through 8, there is illustrated a standard block 10 for building a retaining wall. The block 10 includes a top 14, a bottom 15, two sides 10*a* and 10*b*. The block 10 also includes a split face 11 and a smooth face 12. The smooth face 12 is disposed at one end of said block 10, and the rough split face is disposed proximate the other end of the block 10. A removable portion 12*a* is separated from the main body of the block by a scoreline 13. Should it be desired to have two split faces exposed to an observer, the installer merely cuts along the scoreline 13 to create the second split face 13*a*. The top of the block 10 includes central projections 17 and 18 separated by a space. Each projection 17 and 18 has a leading face 17*a* and 18*a*, and a lagging face 17*b* and 18*b* respectively. The top of the block 14 includes spaced at a distance from the projections 17 and 18 a projection 16 and a projection 19. The projection 16 is at the end of the block near the split face 11 while the projection 19 is disposed near the face of the block 12. Both projections have a leading edge 16*a* and 19*a*, and a lagging edge 16*b* and 19*b* respectively. Key ways 14*a* and 14*b* are disposed between the projections 18 and 19, and the projections 16 and 17, respectively. These key ways are for receiving a key substantially as shown in FIGS. 19 and 19A or the like.

Figure 3:
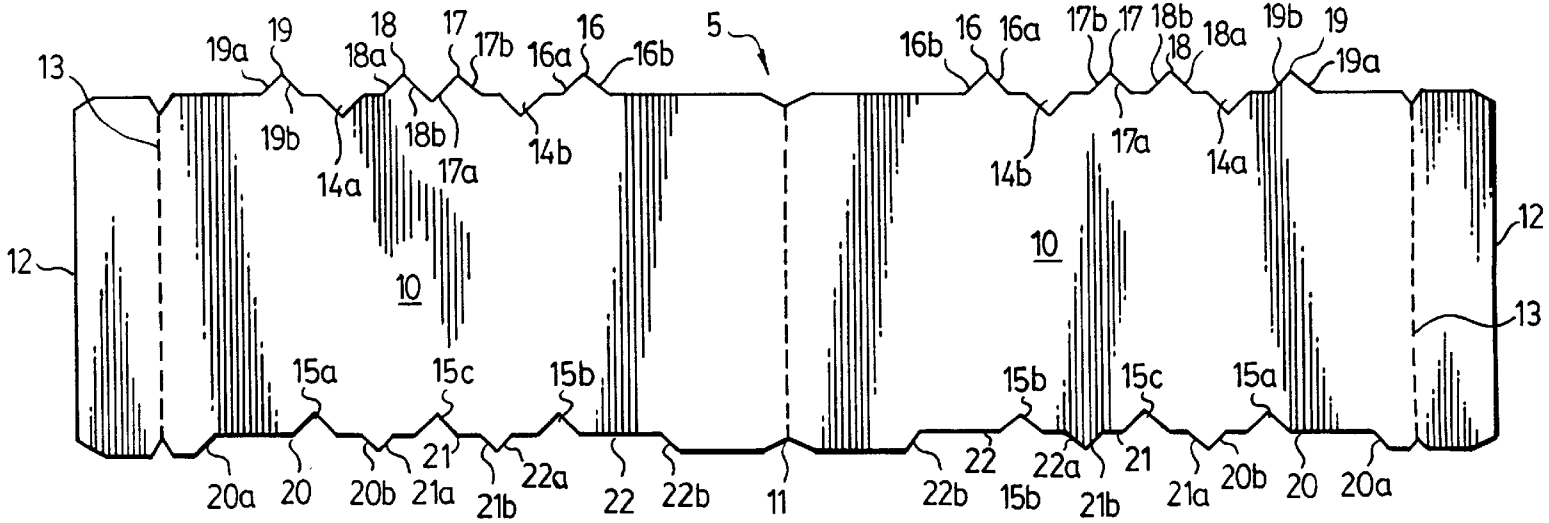
FIG. 3 is a side view of the block of FIG. 1 incorporated into a module including mirror image blocks formed face to face and illustrated in a preferred embodiment of the invention.

The bottom 15 of the block 10 has provided therewith as best seen in FIG. 3 a centrally disposed channel 21 and two slightly larger channels 20 and 22 spaced therefrom. The channel 21 has provided therewith a leading stop or abutment 21*a* and a lagging stop or abutment 21*b*. The channels 20 and 22 also have provided therewith leading and lagging abutments 20*a* and 22*a*, and 20*b* and 22*b*, respectively. Each of the channels 20, 21 and 22 has a key-receiving key way 15*a*, 15*c* and 15*b* provided therewith. Each of the key ways is for mating engagement with the key ways 14*a* and 14*b* disposed proximate the top of the block and for interconnecting with adjacent like blocks 10 within the same course of the retaining wall, which will be described hereinafter.

Figure 4:
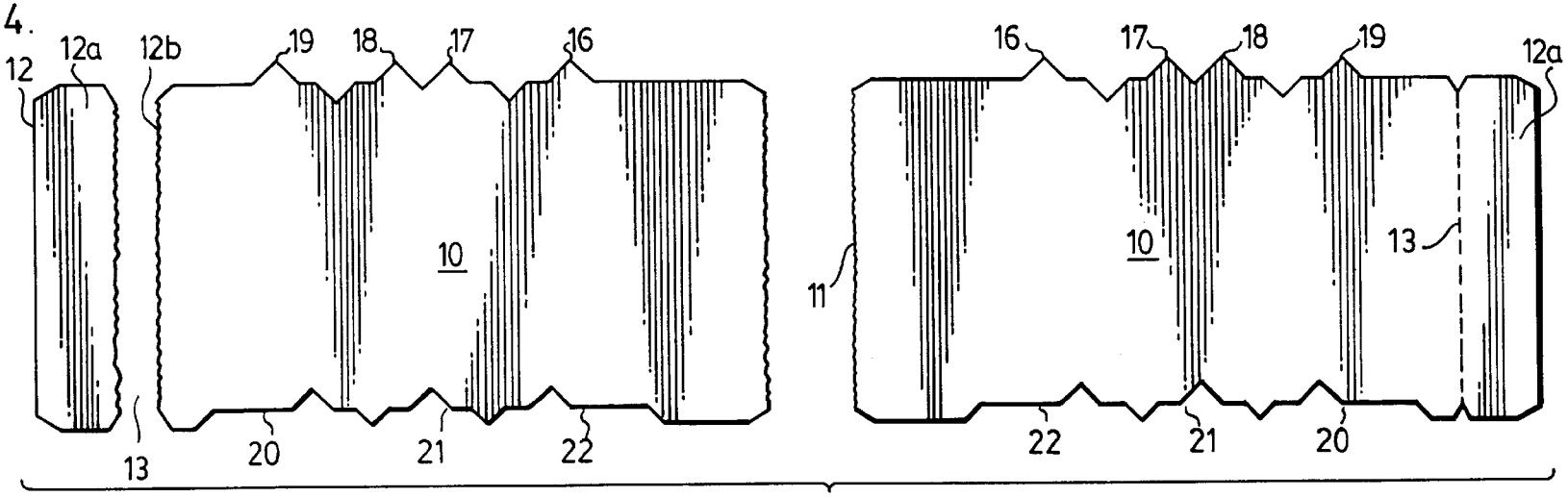
FIG. 4 is a view similar to that of FIG. 3 illustrating the splitting of the blocks and one of the faces as shown and illustrated in a preferred embodiment of the invention.
Figure 7:
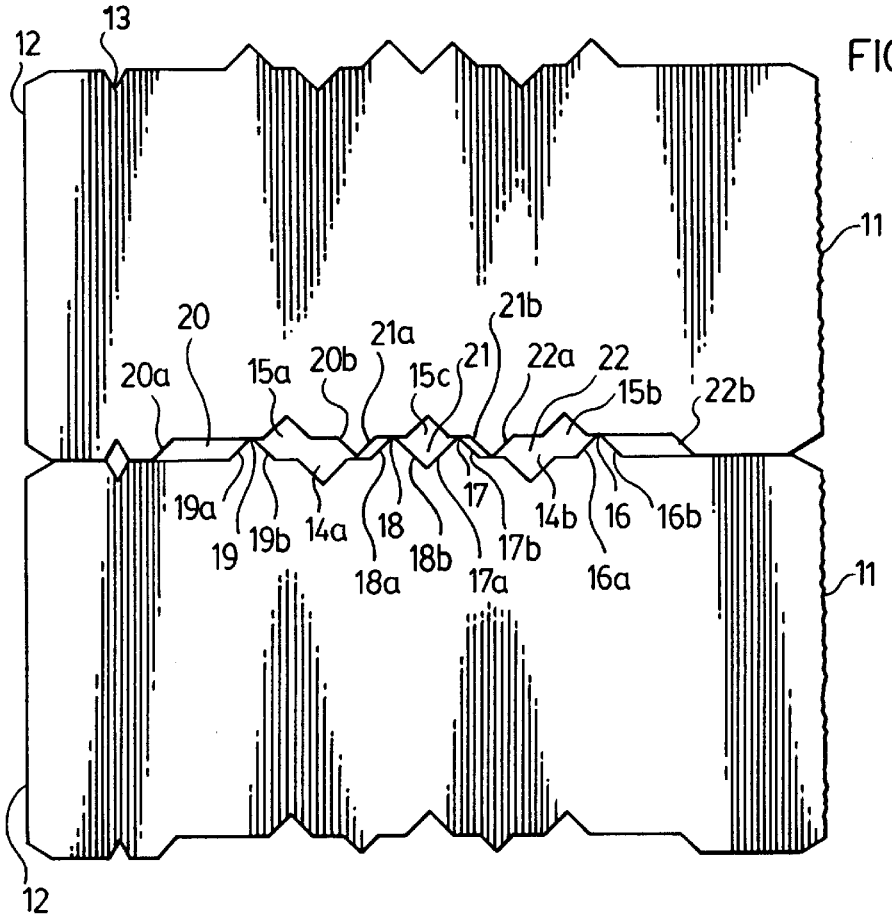
FIG. 7 is a view similar to that of FIGS. 5 and 6 illustrating a superior course stacked upon an inferior course as a substantially vertical wall and illustrated in a preferred embodiment of the invention.
Figure 8:
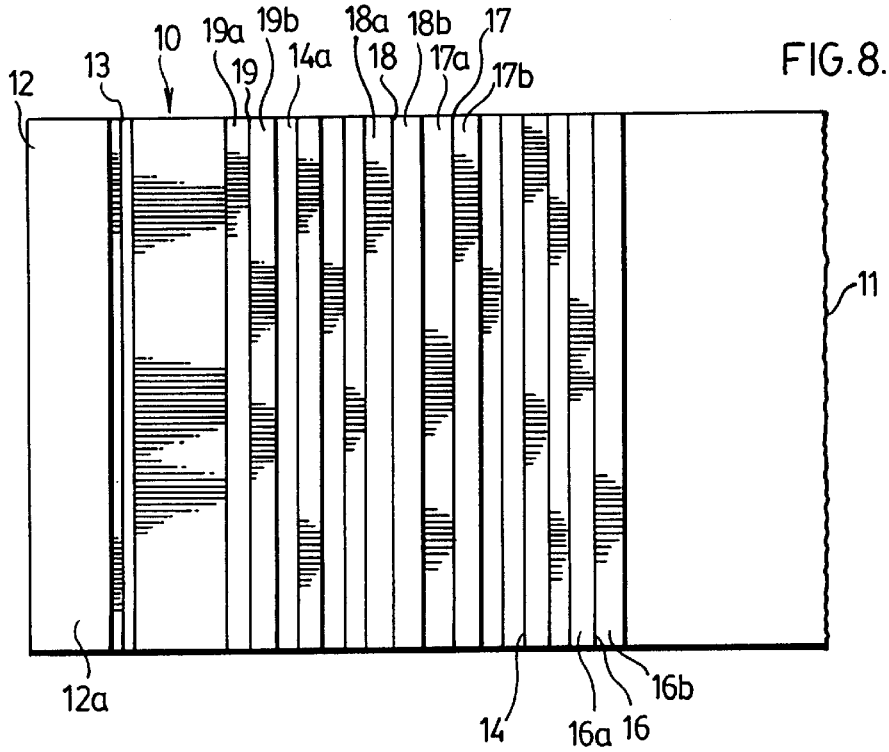
FIG. 8 is a top view of the block of FIG. 7 illustrated in a preferred embodiment of the invention.

The block 10 therefore may be manufactured as a dual block module substantially as shown in FIG. 3 including all of the aforementioned ridges, channels and key-receiving key ways provided therewith and manufactured as mirror images of one another. The module 5 therefore includes two blocks 10 which may be cut along the cutting face 11 to provide two blocks 10 with split faces 11. A section 12*a* is provided with each block which may be cut substantially as shown in FIG. 4 to also provide a split face at 12*b* once the dual block module is separated into its two components. Each of the components are identical and may be placed one upon the other to provide courses when assembling a retaining wall system. One of the main aspects of the invention is that the aforementioned block may be placed course upon course in defining a retaining wall which may be set forward from the vertical substantially as shown in FIG. 5, or which may be set back from the vertical substantially as shown in FIG. 6, or which may be substantially vertical as shown in FIG. 7. In order to accomplish these various wall formations, the installer of the retaining wall will manually place each block course upon course in the desired configuration and pattern. Various patterns may be achieved utilizing the standard block as will be described in relation to FIGS. 27 through 33*b*.

Referring now to FIG. 7, in order to construct a retaining wall having a substantially vertical form, the installer would place the centrally-disposed channel 21 of the superior block course over the projections 17 and 18. In this position, the walls 21*a* and 21*b* of the channel 21 act as abutments and engage with the lagging wall 17*b* of the projection 17 and the leading wall 18*a* of the projection 18. A key may then be installed within the key way 15*c*, for example the key of FIG. 19. The projections therefore engaging the abutments of the recess 21 provides the resistance to horizontal shearing forces upon the wall. The key inserted within channel 21 provides for longitudinal reinforcement along the length of the wall by tying in adjacent blocks to one another and to the inferior course as best seen in relation to FIG. 26.

Figure 27:
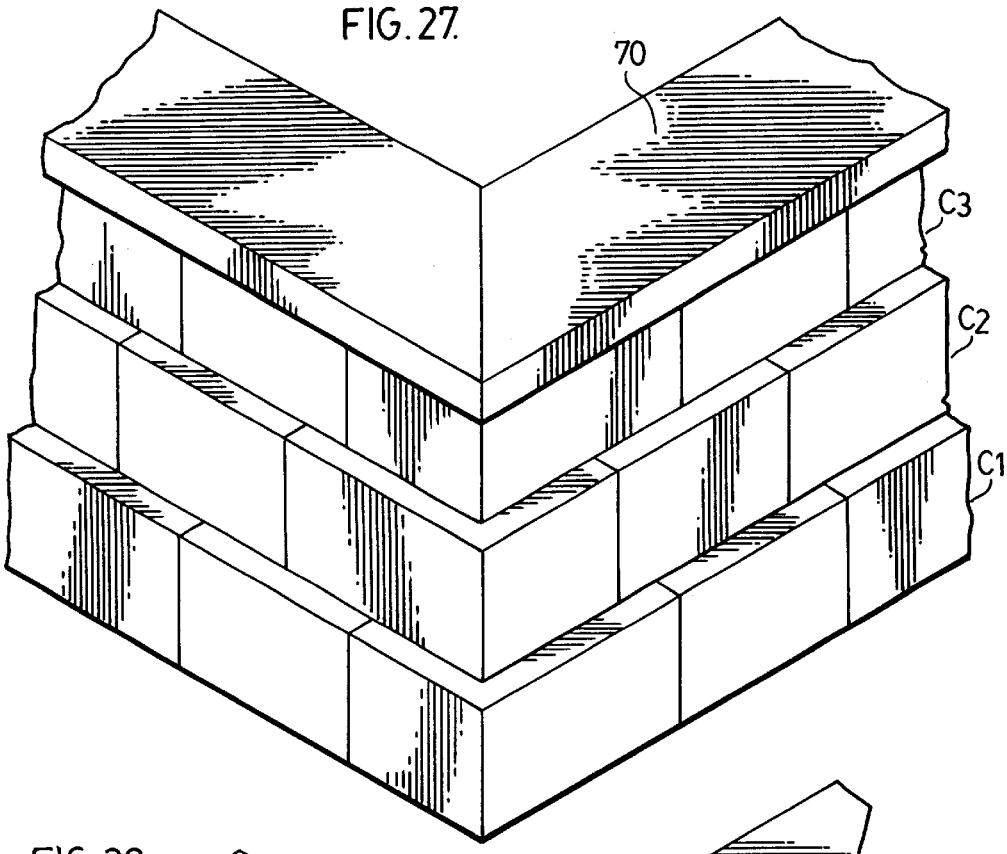
FIG. 27 is illustrated in schematic perspective and illustrates a retaining wall constructed to be set back course upon course from the vertical.

If it is desired to create a retaining wall having a set-back configuration, as seen in FIG. 6, the installer manually places the superior course block 10 upon the inferior course block 10 so that the leading abutment 20*a* engages the leading wall of the projection 19 at 19*a*. In this position, the leading wall 17*a* of projection 17, and the leading wall of 16*a* of projection 16, will abut the leading abutments 21*a* and 22*a* of channels 21 and 22 respectively. Concurrently, the space between the projections 18 and 17 will have contained therein in this position the portion of the bottom of the block 10 between the lagging wall 20*b* of channel 20 and the leading wall 21*a* of the channel 21. The contact of all of these walls and abutments will therefore provide for the resistance to horizontal shearing forces of the superior and inferior courses. Furthermore, the key ways 14*a* and 14*b* and/or the key ways 15*a*, 15*b* and 15*c* may have selectively provided therewith keys of a design substantially as shown in FIG. 19 or 19A or the like in order to tie in blocks adjacent to one another and to inferior and superior courses in a set-back wall configuration substantially as seen in FIG. 27. The key therefore provides the longitudinal tying in and bolstering ofthe courses of the retaining wall and the prevention of separation of the blocks in the longitudinal direction.

Figure 32:
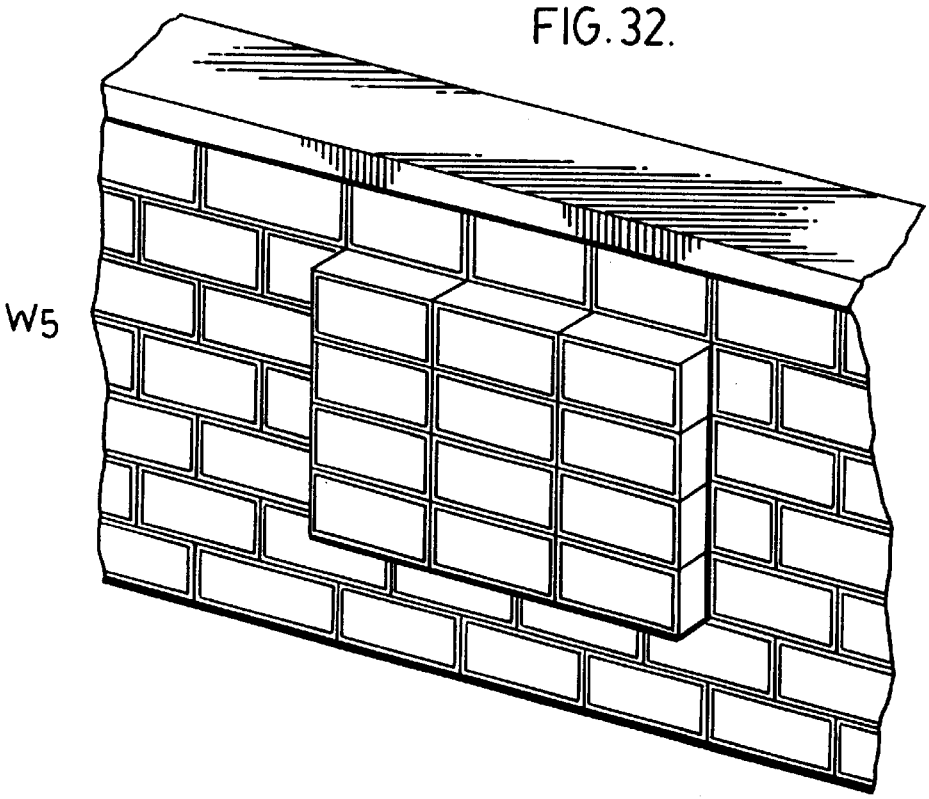
FIG. 32 is a schematic view of another embodiment of the invention.

Similarly, should a landscaper require a wall which may be set forward from the vertical, or at least a portion of the wall which may be set forward from the vertical as seen in FIG. 32, the installer is merely to place the block in a position so that the lagging abutment 22*b* of the channel 22 on the superior course abuts with the lagging wall 16*b* of the projection 16. In this position, the lagging wall 19*b* of projection 19 will abut to the lagging abutment 20*b* of channel 20 while the lagging abutment 21*b* of channel 21 will abut with the lagging wall 18*b* of projection 18. In this regard, the space defined between projections 18 and 17 will capture the portion of the bottom disposed between the lagging abutment 21*b* and the leading abutment 22*a* of channels 21 and 22, respectively. In this position therefore, the block is maintained in a stable position being set forward from the vertical in a predetermined number of courses or for the entire wall, if necessary. As previously discussed, the key-receiving key ways 15*a*, 15*b*, 15*c*, 14*a* and 14*b* may include keys substantially as shown in FIG. 19 or 19A or the like to further bolster the retaining wall in the longitudinal direction and for the superior and inferior courses.

Figure 11:
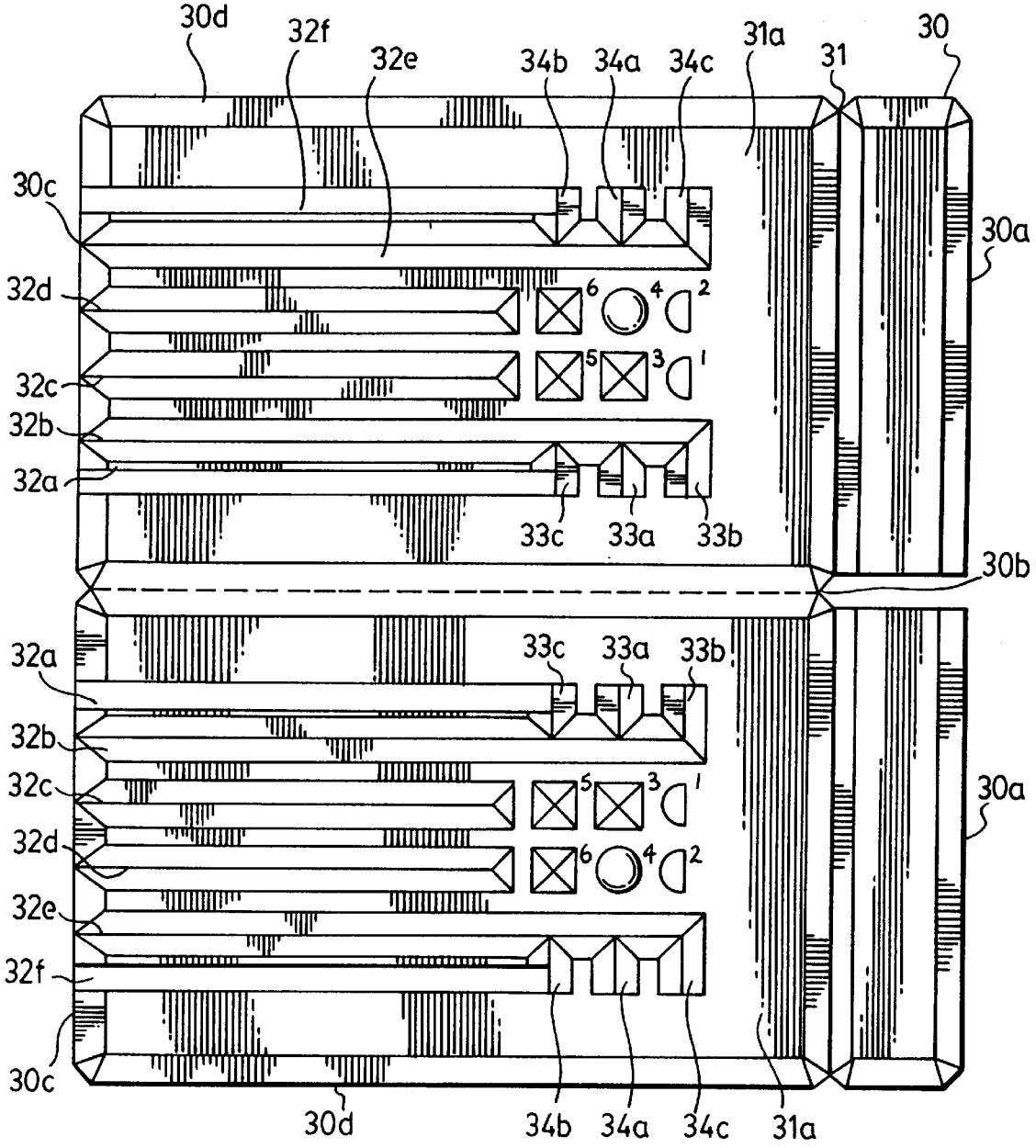
FIGS. 11, 11A and 11B are top views of double-block modules for corner blocks as shown in FIGS. 9, 9A, 9B, 10, 10A and 10B illustrated in preferred embodiments of the invention.
Figure 11A:
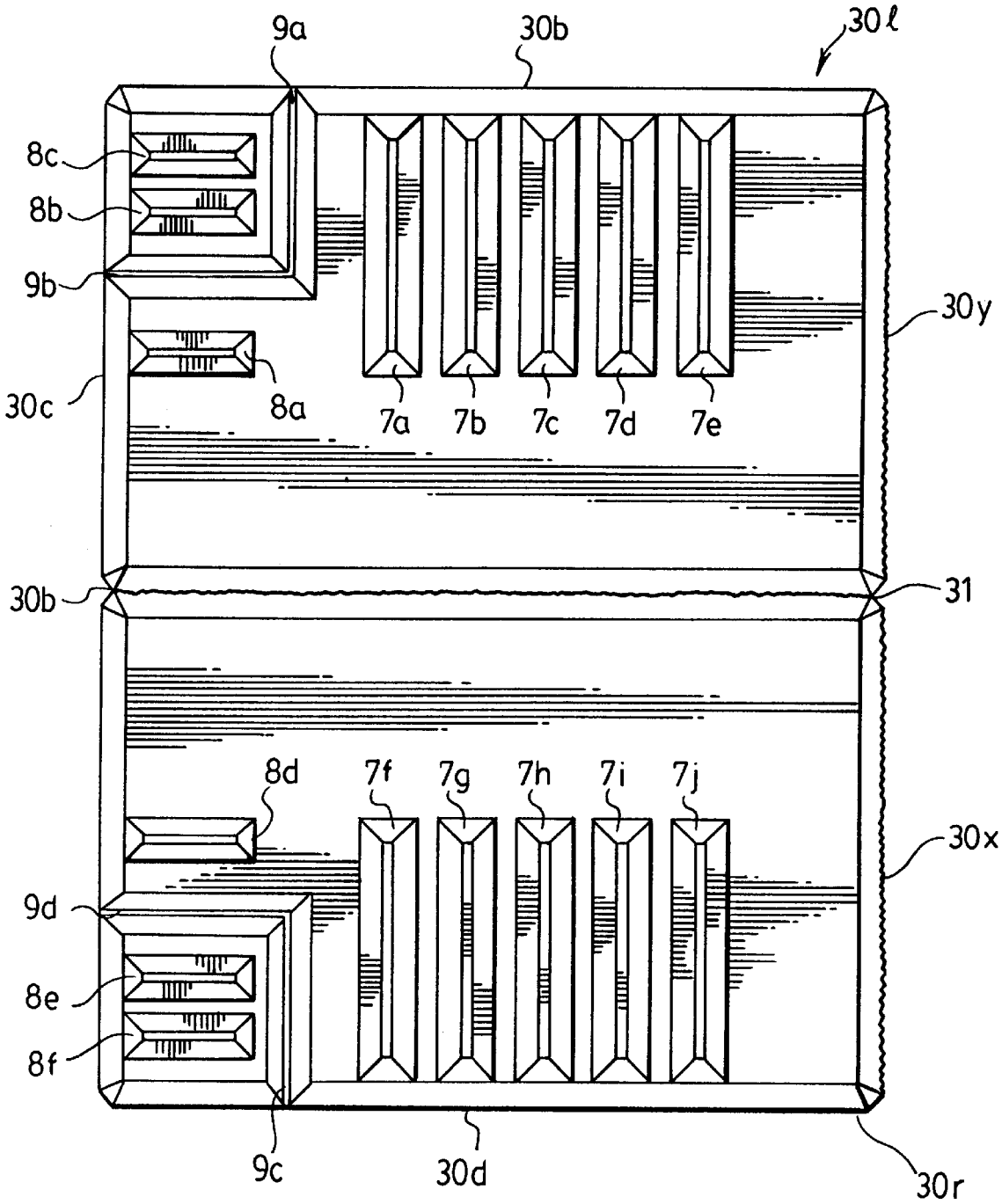
Figure 11B:
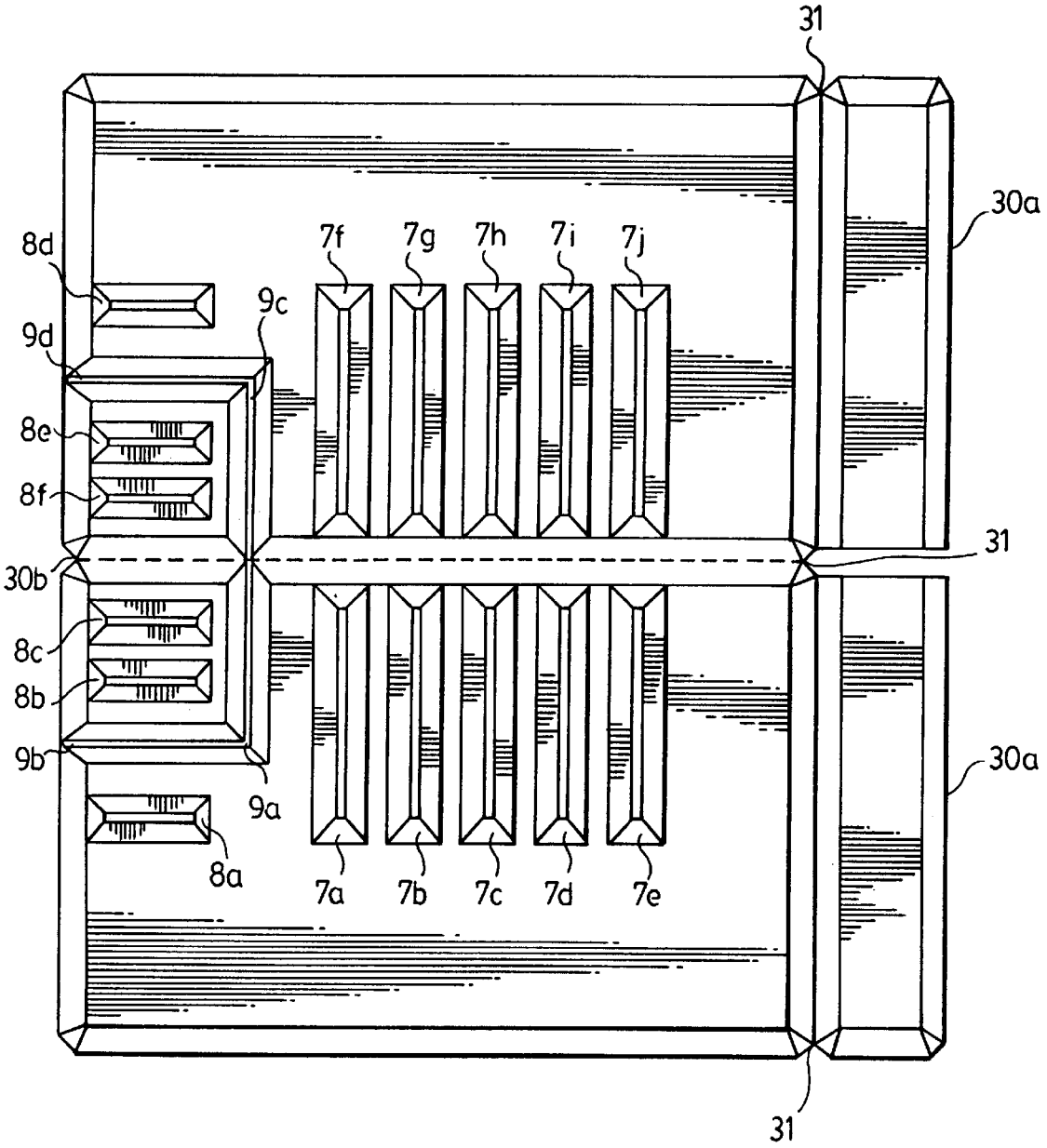

Referring now to FIGS. 9 through 16B, there is illustrated a corner block 30. The corner block 30 includes a top 31*a*, a bottom 31*b*, two faces 30*a* and 30*c*, and two sides 30*b* and 30*d*. The corner block 30 may therefore be formed in a dual block module formed substantially as seen in FIGS. 11, 11A and 11B which are joined along the scoreline 30*b* and which are separated thereat if desired to form two distinct blocks, each block being similar in design and being a left and a right-hand block. The bottoms of the blocks 31*b* include a multiplicity of recesses 35*a* through 35*f* which in combination with keys substantially as seen in FIGS. 19 and 19A or the like are used to inter-engage the corners when stacked one upon the other in various patterns and further to tie into adjacent blocks which are not corners.

Figure 1:
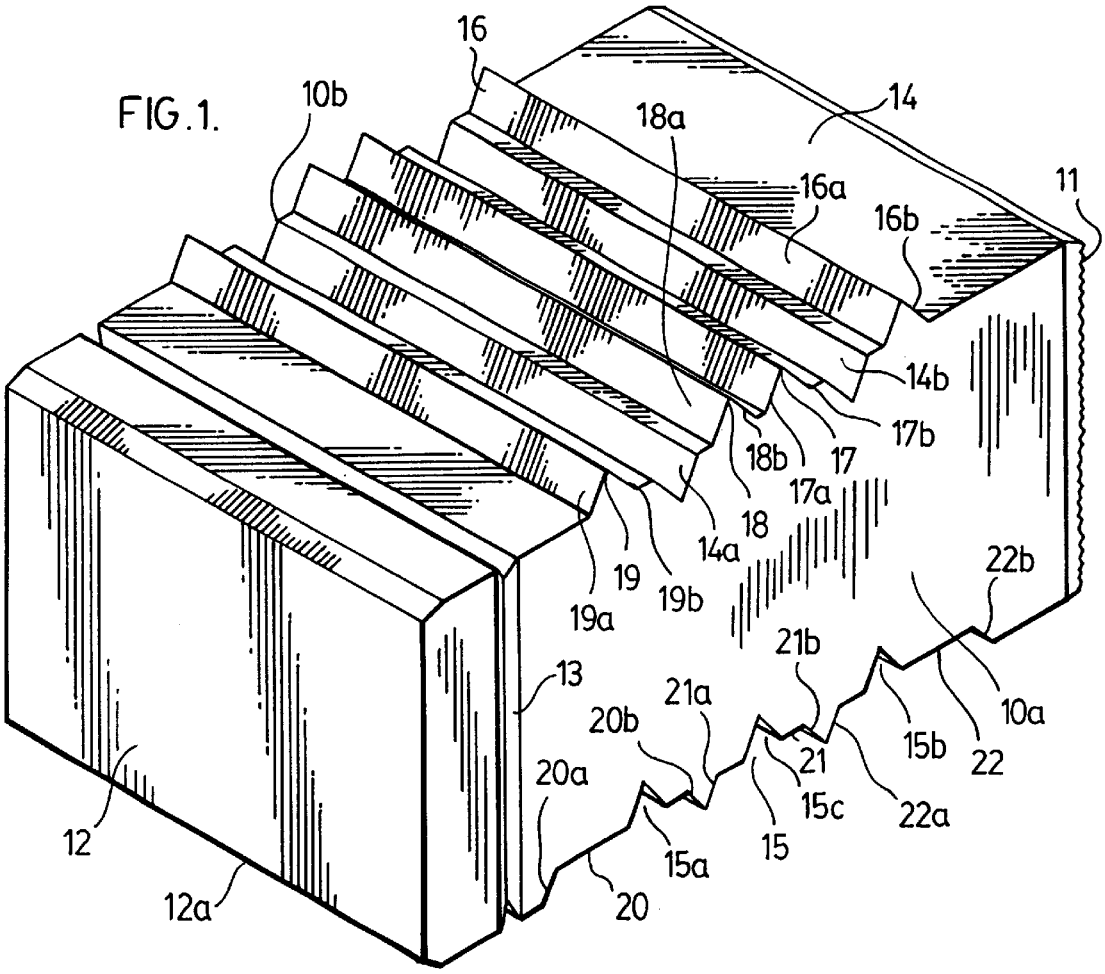
FIG. 1 is a perspective view of a standard block shown in perspective and illustrated in a preferred embodiment of the invention.
Figure 2:
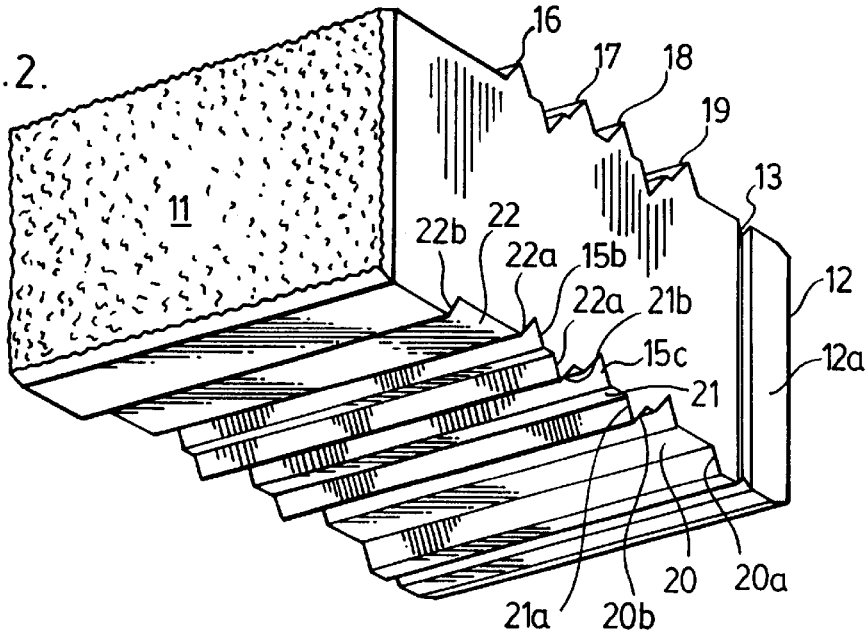
FIG. 2 is a rear perspective view of the block of FIG. 1 showing the split face thereof and illustrated in a preferred embodiment of the invention.
Figure 9:
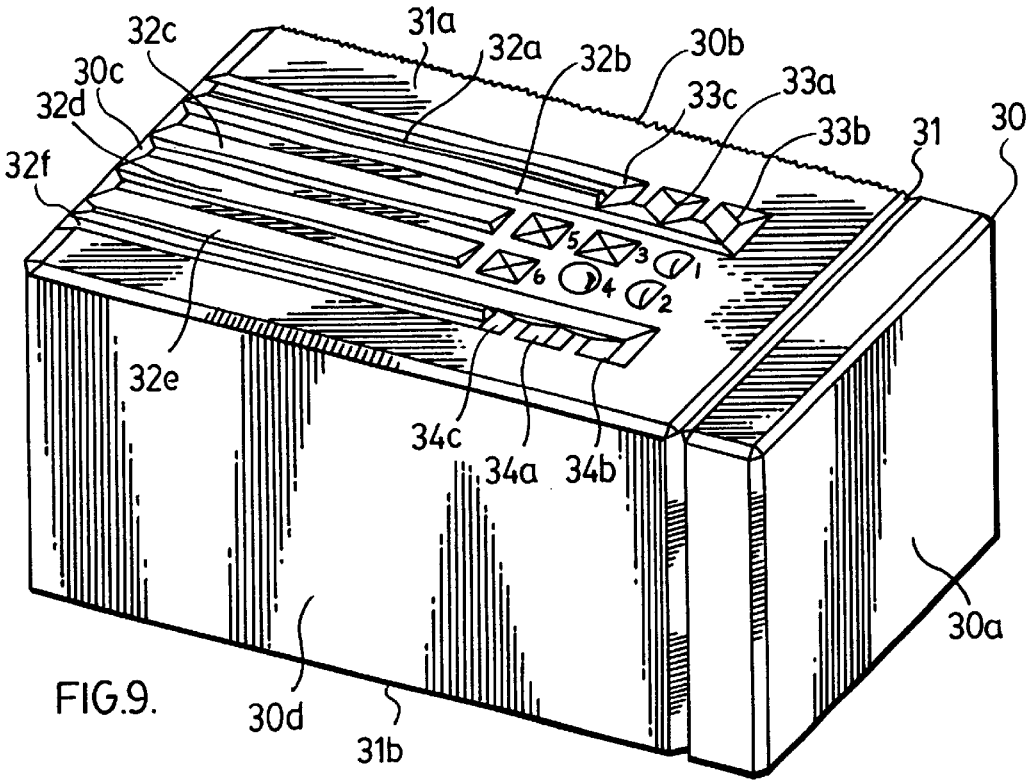
Figure 10:
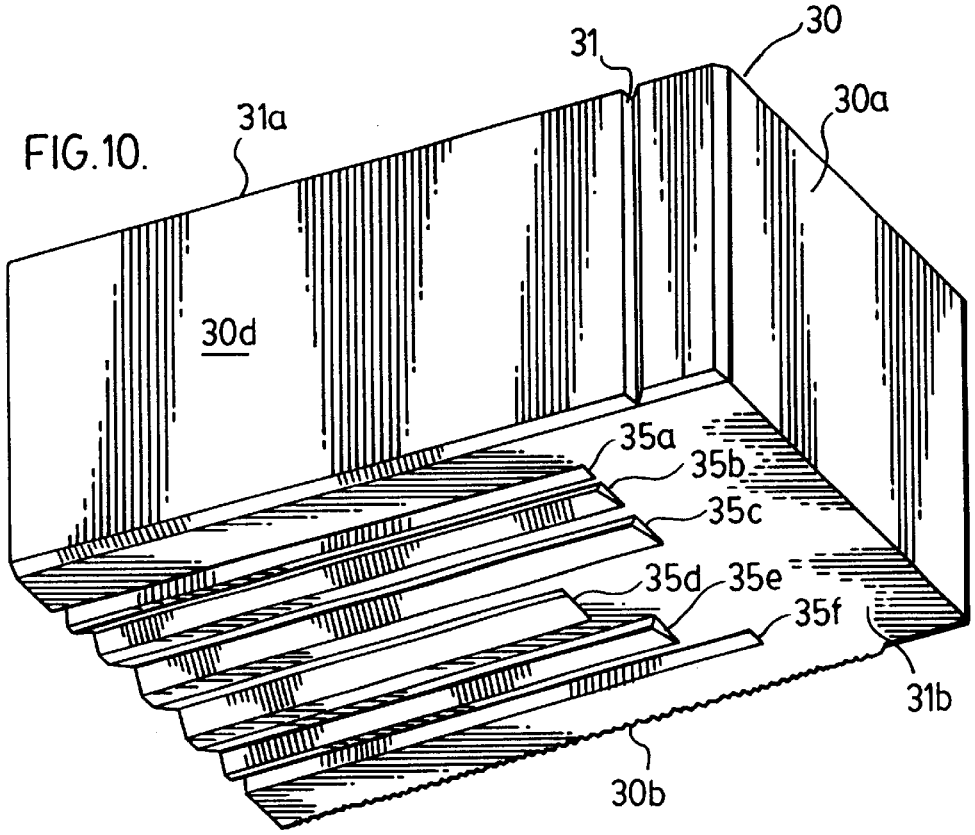
Figure 22:
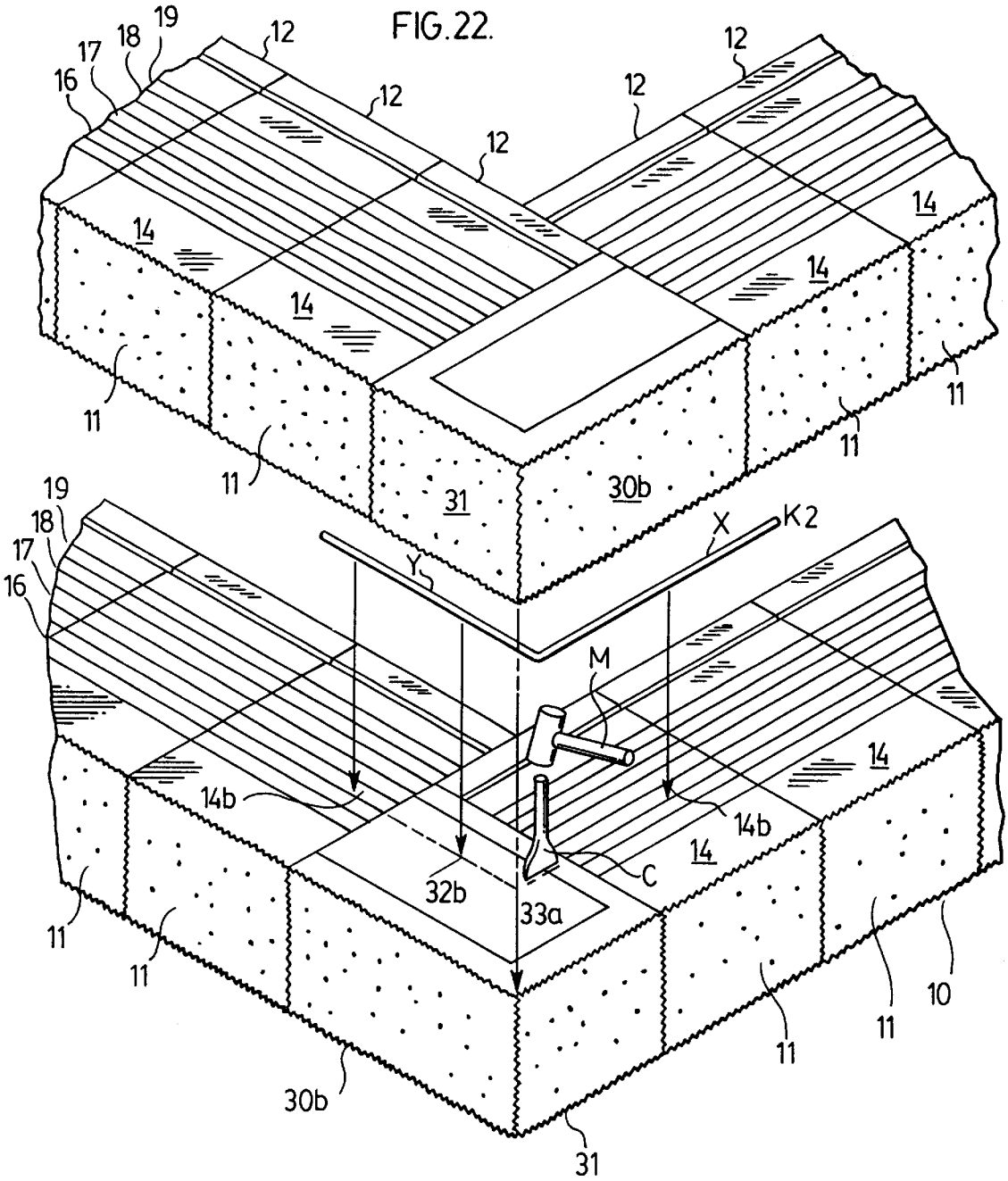
FIG. 22 is an exploded schematic perspective view of a split-face retaining wall and the longitudinal reinforcement thereof and illustrated in a preferred embodiment of the invention.
Figure 23:
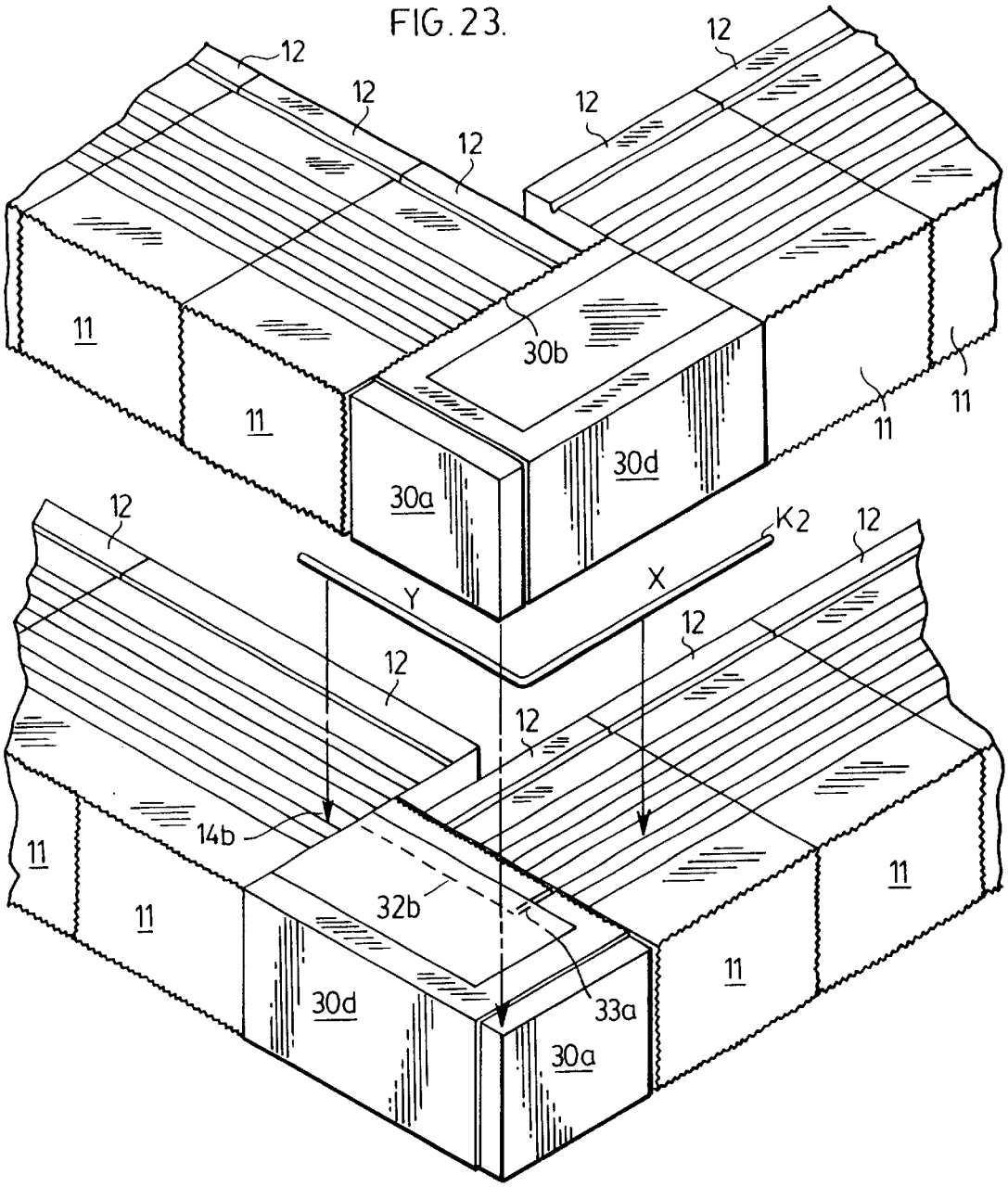
FIG. 23 is a view similar to that of FIG. 22 with the exception that the corner of the retaining wall presents a smooth face when a superior course is mounted upon an inferior course.

The block of FIG. 9 includes recesses 3, 5 and 6 for receiving projections 1, 2 and 4 from like blocks when stacked one course upon another if desired. The top of the block includes recesses 32*a* through 32*f* extending from face 30*c* toward the face 30*a*. The top of the block 30 also has provided therewith smaller channels or recesses 33*a* through 33*c* which may be extended by an installer substantially as seen in FIG. 22 in order to provide longitudinal reinforcing of the retaining wall and tying in of the corner block with adjacent blocks, preferably blocks as seen in FIG. 1, and the superior and inferior corner blocks.

Alternative block constructions may also be used to interfit with the corner 30 providing that the block construction includes key-receiving key ways disposed on the top and bottom of the blocks. This will be described hereinafter in relation to FIGS. 34–37.

Figure 9A:
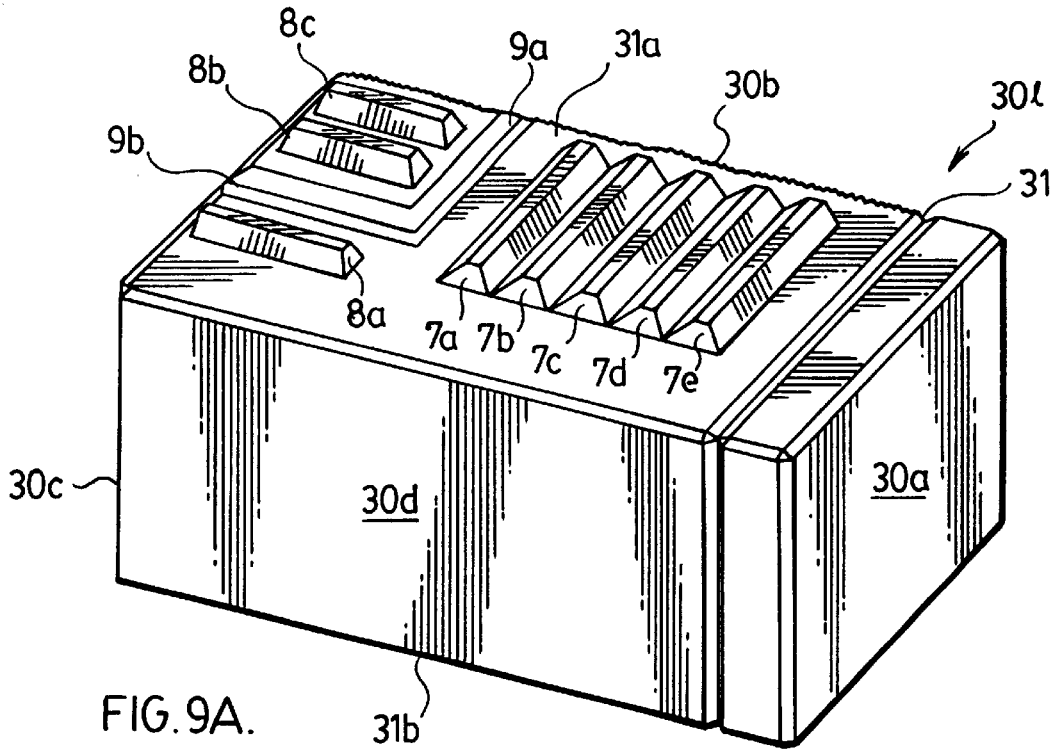

If desired, the block of FIG. 9 may present two smooth faces at 30*a* and 30*d*. Alternatively, if the installer removes the removable segment including the face 30*a*, he will expose a split face as seen in FIG. 22 depending on the esthetic look desired by the installer. It will be noted that the left-hand and right-hand blocks of FIG. 9 are identical with the exception of the location of the projections 1, 2 and 4 in the recesses 3, 5 and 6. Therefore, the left- and right-hand corner blocks 30 are to be utilized as preferably a right- and a left-hand corner. However, this may not always be the case as only one particular block may be available, for example when individual blocks are formed rather than the dual block modules. The blocks of FIG. 9 therefore are reversible and may be utilized in the fashion best seen in FIGS. 14, 15 and 16. If only one of the style of blocks is available, then the block may be reversed and rotated 90° in order to align the projections 1, 2 and 4 with the pockets 3, 5 and 6 in order to provide the necessary corner constructions if desired. However, this is not recommended as the best alternative. The blocks illustrated in FIGS. 9A and 9B are not reversible. As best seen in FIG. 22, when a corner block is installed with a standard block, the channels 33*a*, for example, of the right-hand block shown in FIG. 11 may be extended using a masonry's chisel C and a mallet M to align the channel which is extended from 33*a* with the key-receiving key way 14*b* of the standard block 10. In this manner, a key K2 may be placed in the recess 32*b* and the recess 33*a* extending from the corner block to tie in adjacent blocks 10 and to inferior and superior courses. The recess 14*b* is tied in, for example, when it is desired to create a square vertical retaining wall. When the next course is therefore installed, the block 30 at the corner thereof is reversed substantially as seen in FIG. 32 so that the channels 35*b* and 35*c* align with the projections 1, 2 and 4 of the top of the inferior course block while the superior corner block 30 is rotated 90° from the inferior course block. For FIG. 22, the smooth faces 30*a* have been removed by the installer.

Figure 10A:
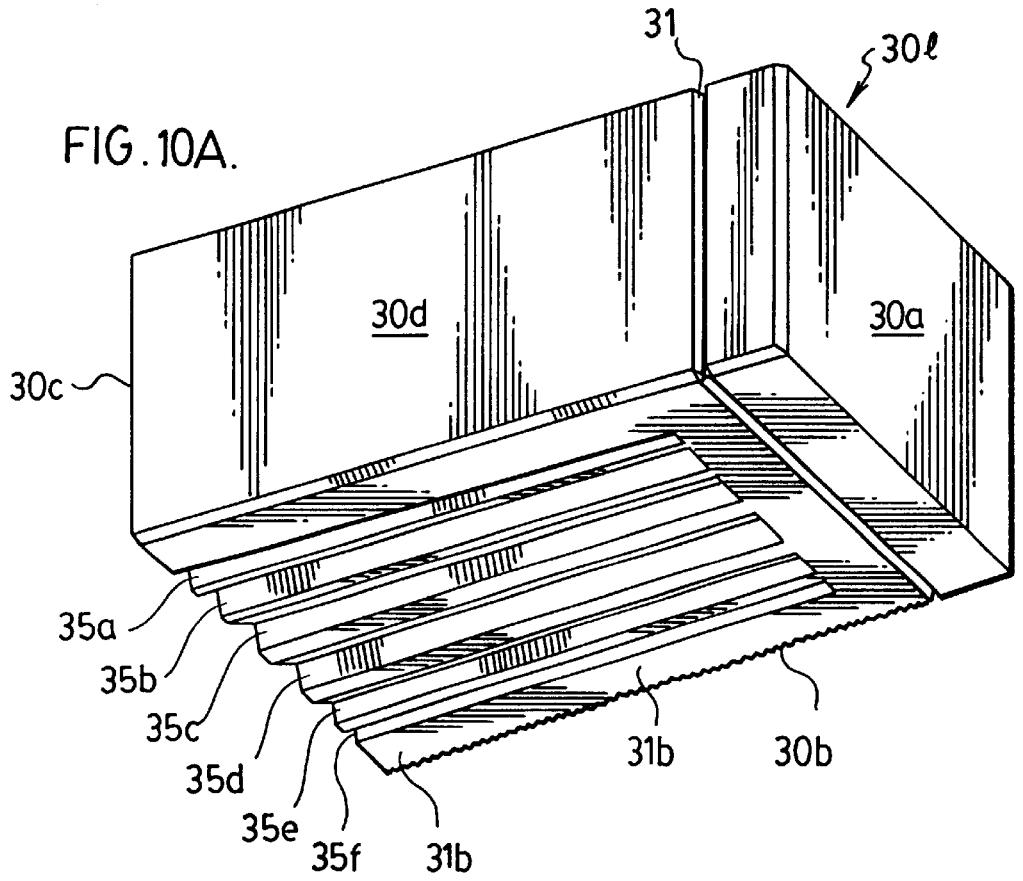

Referring now to FIGS. 9A, 9B, 10A, 10B, 11A, 11B, 12A, 12B, 13A, 13B, 14A, 14B, 15A, 15B, 16A and 16B, there is illustrated a left corner block 30*l* as best seen in FIGS. 9A and 10A, and a right corner block 30*r* as best seen in FIGS. 9B and 10B. These two blocks 30*l* and 30*r* may be manufactured from a double-block module as discussed previously. For example, the left-hand block 30*l* may be manufactured in a double block module as best seen in FIG. 11B wherein the block 30*l* of FIG. 9A would be the bottom block of the double module of FIG. 11B. Further, the block of FIG. 9B may be the bottom block 30*r* of FIG. 11A being a right-hand block. Each of the modules has provided therewith a score line 30*b* which is utilized by the installer to separate the two blocks of the double-block module. Therefore, as seen in FIGS. 9A and 9B, the face 30*b* presents a split face resulting from separating the two blocks constituting the double-block module. As best seen in FIG. 11A, the block 30*l* constitutes a left-hand corner, and the block 30*r* constitutes a right-hand corner. This block is normally manufactured with a rough face 30*x* and 30*y*. The right-hand corner block 30*r* therefore as shown in FIG. 9B includes two rough faces 30*b* and 30*x* which may be presented to the outside of the finished wall as best seen in relation to FIG. 16A. The corner block 30*l* of FIG. 9A therefore includes laterally-extending ridges 7*a* through 7*e* and longitudinally-extending ridges 8*a* through 8*c*. Key-receiving keyways 9*a* and 9*b* are provided at right angles to one another in order to interconnect the corner block 30*l* with adjacent standard blocks as previously described with keys as best seen in FIG. 19A. The blocks 30*r* of FIGS. 9B and 10B include laterally-extending ridges 7*f*, 7*g*, 7*h*, 7*i* and 7*j*, and longitudinally-extending ridges 8*d*, 8*e* and 8*f*. A pair of keyways 9*d* and 9*c* extend at 90° to one another adjacent one end and one corner of the corner block. Disposed upon the bottom of the block 30*l* and 30*r* are longitudinally-extending grooves 35*a* through 35*f* for receipt of either the ridges 7*a* through 7*e* for block 30*l* or ridges 7*f* through 7*j* for block 30*r*. If the corner block of the superior course is rotated at 90°, the corner block of the inferior course, as best seen in FIGS. 16A and 16B, then the ridges 7*a* through 7*e* and 7*f* through 7*j* respectively will be aligned with the grooves 35*a* through 35*f* located on the bottom 31*b* of the corner blocks 30*l* and 30*r* respectively. The ridges 8*a* through 8*c* and 8*d* through 8*f*, and the keyways 9*a* and 9*b* of block 30*l* and 9*c* and 9*d* of block 30*r* are utilized as best seen in relation to FIGS. 22 and 25 respectively to tie into the standard blocks as determined by the installer in conjunction with key-receiving keyways 9*a* and 9*b*, and 9*c* and 9*d* to tie the adjacent standard blocks, as previously described and illustrated in relation to FIGS. 1 and 2, to the corners. Therefore, block 30*l* will be utilized as a left-hand corner with standard adjacent blocks being disposed adjacent the sides 30*b* and 30*c* to enable keys, not shown but illustrated in relation to FIGS. 19 and 19A to be inserted within the grooves 9*a* and 9*b* and extending beyond the boundaries of the block 30*l* to standard blocks and the grooves established therein. The block 30*l* as seen in FIGS. 11A and 9A illustrate two corner blocks having a split face 30*x* and 30*y* which blocks are not interchangeable. The block 30*l* will be used for providing blocks adjacent to side 30*c* and 30*b* so as to provide a corner which ties into blocks disposed on the left-hand side 30*c* and the top side 30*b*. The bottom block 30*r* is designed to tie into adjacent blocks on the bottom side 30*d* and the side 30*c*. The blocks of FIG. 11B are designed with a smooth face 30*a* and a score line 31 and provide the same corners for the installer in an alternative double-block module.

Referring to FIGS. 12A and 13A, such a design for a corner block is meant to allow for tying in to blocks disposed adjacent the faces 30*c* and 30*d* in a manner as previously described. FIGS. 12B and 13B are provided with a smooth face 30*c* to tie into blocks adjacent the ends 30*a* and 30*b*. Therefore, considering a wall which extends totally around the perimeter of a home, Applicant has provided the ability to tie into left-hand side corners and right-hand side corners at both the extremities of the wall so formed.

Figure 14:
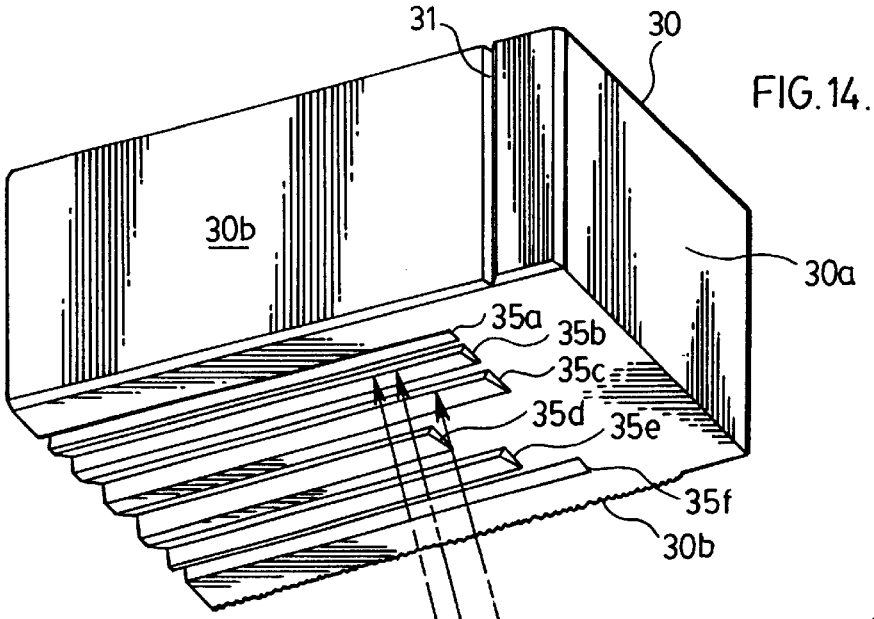
FIGS. 14, 14A, 14B, 15, 15A and 15B are exploded perspective views of the manner in which superior corner blocks are laid upon inferior corner blocks and illustrated in preferred embodiments of the invention.
Figure 15:
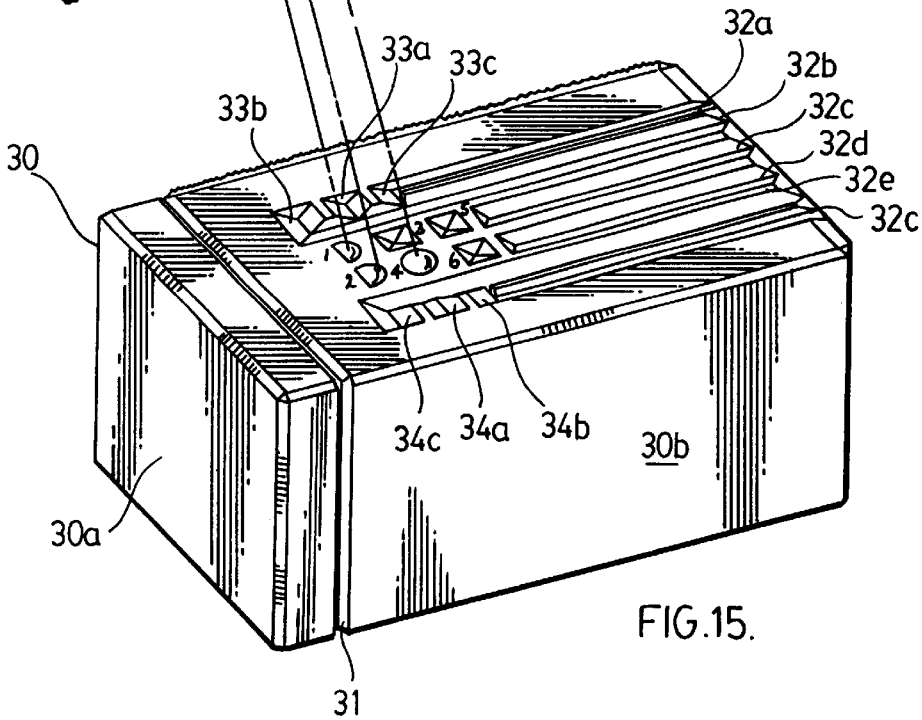
Figure 16:
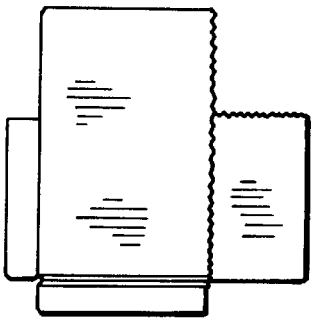
FIGS. 16, 16A and 16B are top views of FIGS. 14, 14A, 14B, 15, 15A and 15B combined.
Figure 14A:
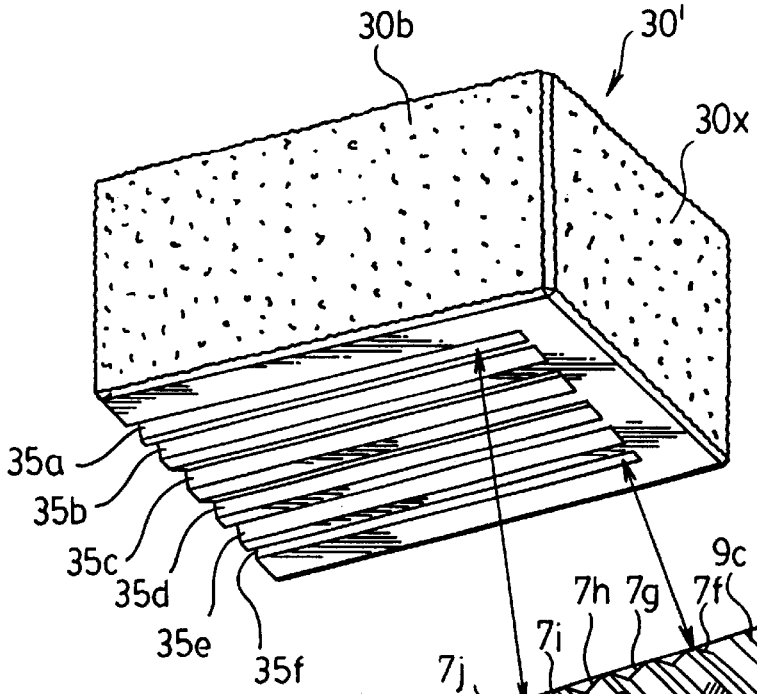
Figure 15A:
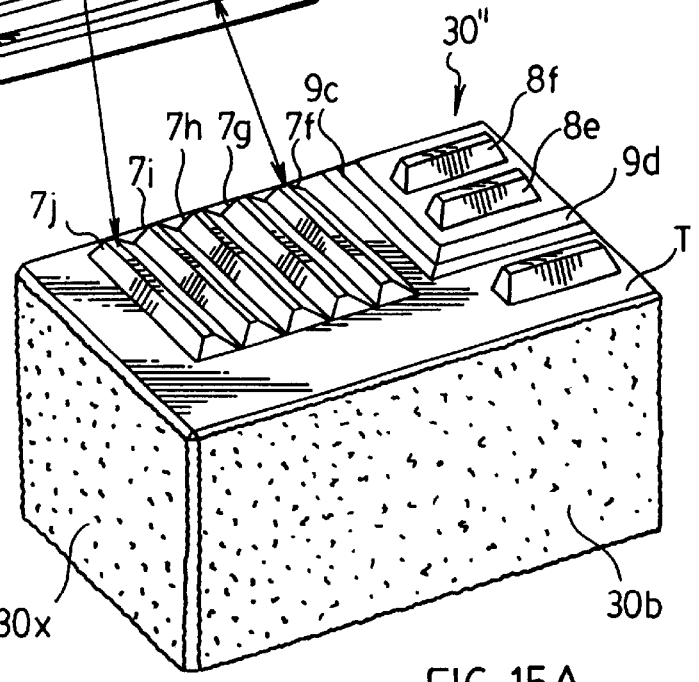
Figure 16A:
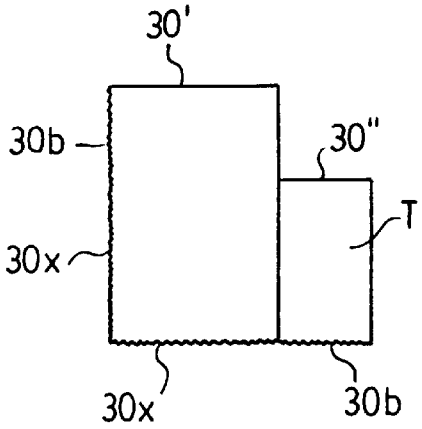
Figure 14B:
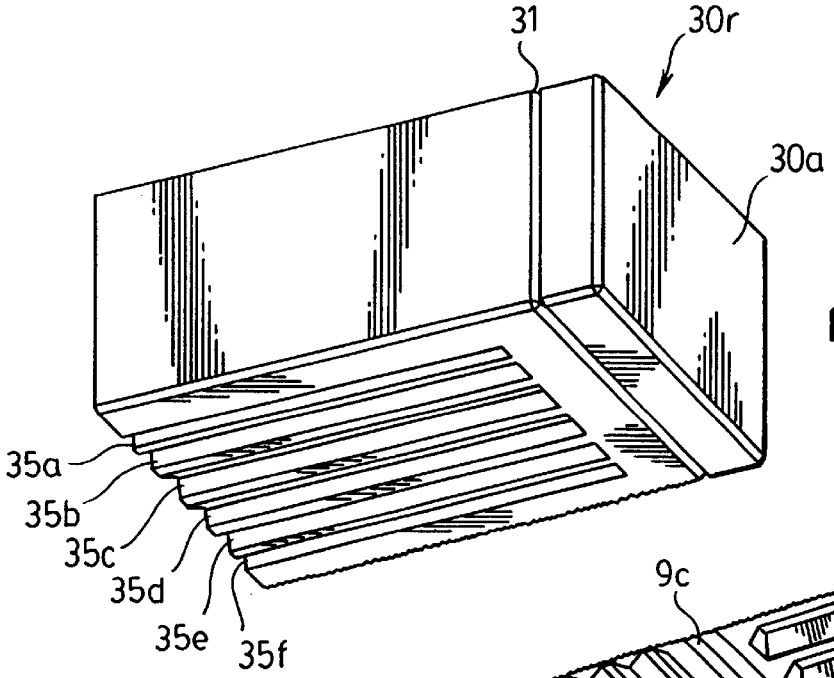
Figure 15B:
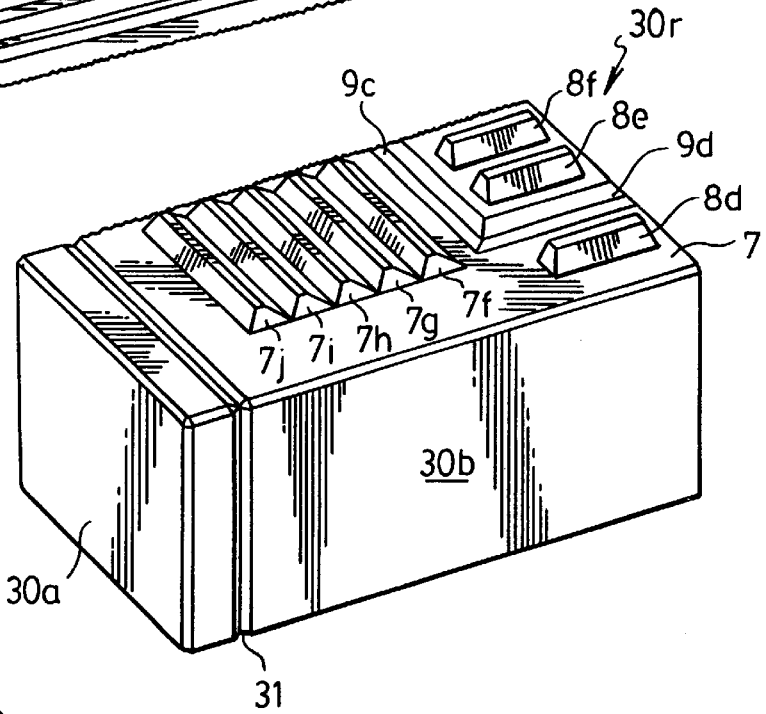
Figure 16B:
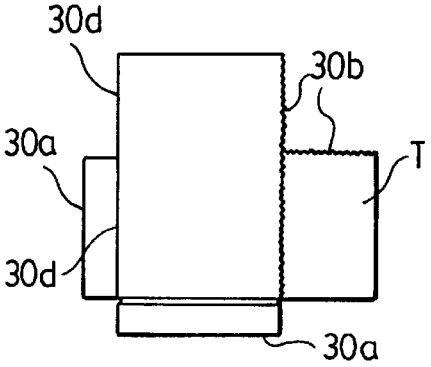

Referring now to FIGS. 14A, 14B, 15A, 15B, 16A and 16B, there is illustrated a manner in which a superior course of blocks will be fit upon an inferior course of blocks, both representing a corner, similar in respects to FIGS. 14, 15 and 16 with the exception that very positive ridges 7*a* through 7*e*, and 7*f* through 7*j* are provided to interfit with grooves 35*a* through 35*f* in a manner best seen in relation to FIG. 22 and described in relation thereto. Referring now to FIG. 22 in relation to FIGS. 14A, 15A and 16A, the corner 30' is to be set upon corner block 30", wherein the inferior course block with regard to the ridges 7*f* through 7*j* are inserted within the grooves 35*a* through 35*f* of the superior course block 30'. The standard blocks 14 of FIG. 22 therefore will therefore interfit with the appropriate corner block. With reference to FIG. 22, the appropriate corner block would be that of FIG. 9A with the split face being exposed by separating the portion 30*a* at score line 31. In this respect, the grooves 9*a* and 9*b* would be alignable with compatible keyway-receiving grooves 14*b* of the standard blocks 14 prior to installing the superior course. The superior course corner block 30 would be rotated at 90° utilizing the appropriate corner block designed to tie into the adjacent blocks 14. Specifically, with reference to FIG. 22 and the embodiments of FIGS. 9A through 19A respectively the installer is not required to extend any of the key-receiving keyways as is the case in describing blocks with respect to FIGS. 9, 10, 11, 12, 13, 14, 15 and 16. As can be readily seen from FIGS. 14B and 15B, the smooth faces are exposed when providing the corner joint in a similar manner to that of FIGS. 14A, 15A and 16A. With respect to defining the corner and interfitting it with the balance of the wall assembly, referring to FIG. 25, such a corner assembly is provided which readily juts out from the main plane of the wall defined by the standard blocks. Otherwise the construction is identical.

Figure 17:
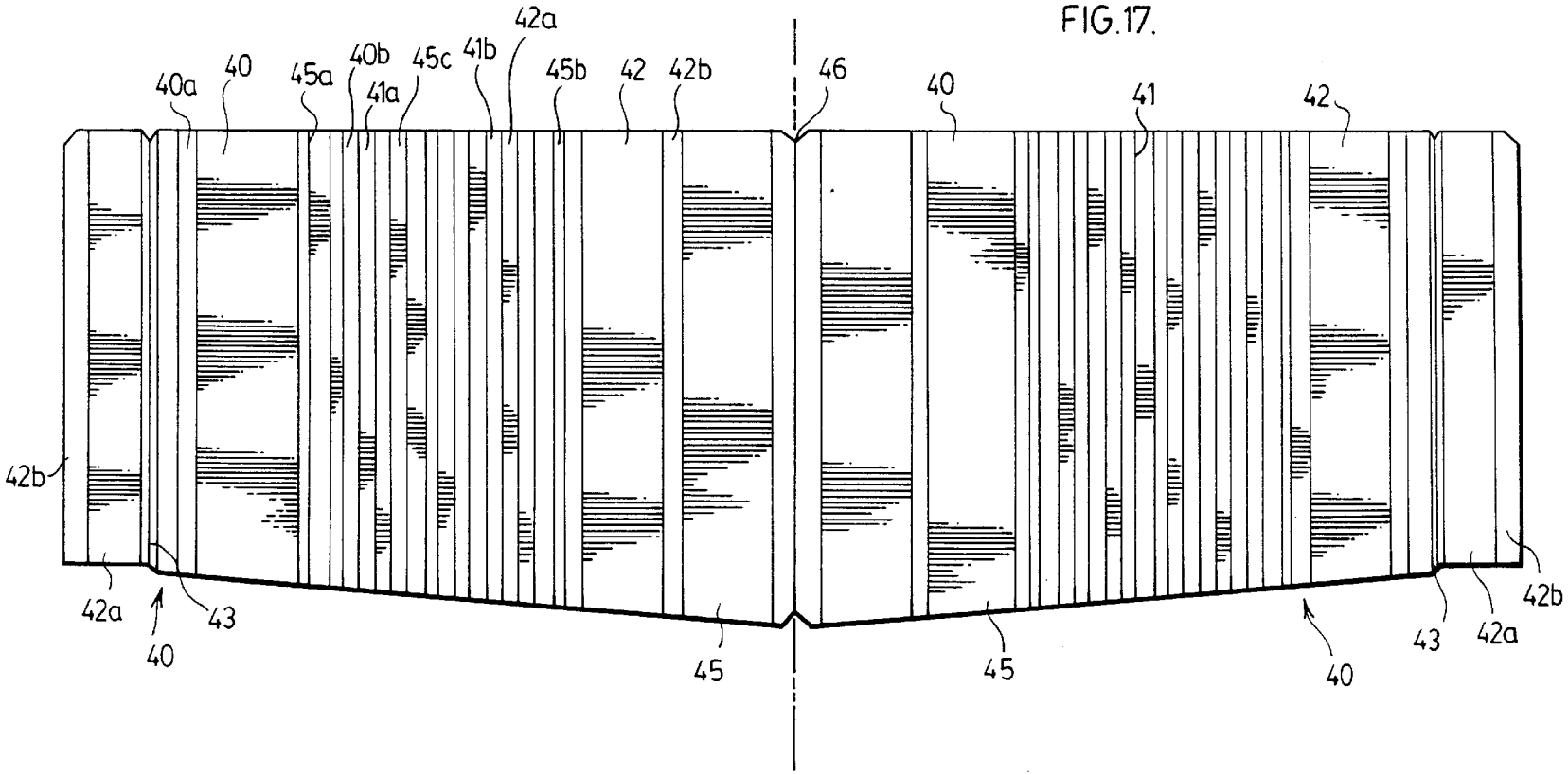
FIG. 17 is a substantially tapered block illustrated as a double-block module similar to that of FIG. 3 with the exception of the shape of the block and illustrated in an alternative embodiment of the invention.
Figure 18:
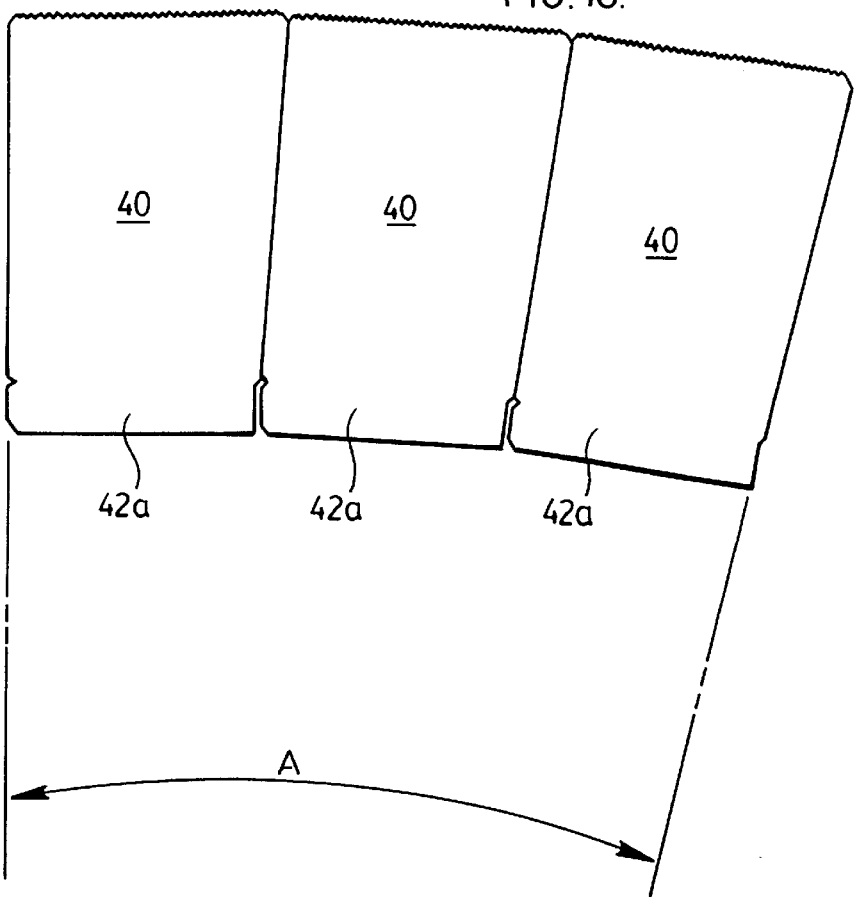
FIG. 18 is a schematic view of how the blocks of FIG. 17 might be used in preparing a retaining wall.

Referring now to FIGS. 17 and 18, there is illustrated a wedge-shaped block similar in all respects to the configuration of the block illustrated in FIG. 1 with the exception that the side walls converge. A removable portion 42*a* therefore is provided with the wedge-shaped block 40 having a removable section 42*a* which is separated from the body of the block at 43. This block may be formed in a dual block module joined at 46 and separable thereat. The bottoms of the blocks are illustrated in FIG. 17 or in channels 40, 41 and 42 are illustrated with the details including the leading and lagging walls 40*a*, 40*b*, 41*a*, 41*b*, 42*a* and 42*b*, respectively, for each of the channels 40, 41 and 42 with key-receiving key ways 45*a*, 45*c* and 45*b* disposed there between. The structure is therefore identical in side view to that seen in relation to FIG. 3. Particularly, this wedge-shaped block may be used when it is desired to create an arc A, as best seen in FIG. 18, wherein like blocks 40 are set adjacent to one another along the arc, with or without the removable section 42*a*. In this embodiment, small key sections of approximately 3" may be utilized to join blocks adjacent to one another. It is difficult to provide one entire continuous key length when traversing an arc.

Referring now to FIGS. 19 and 19A, there are illustrated keys K1 having a diamond shape, and K2 having a hexagonal shape, and having indeterminate length L and having a hollow H therein. The keys may be cut into pre desired lengths in order to assemble the retaining wall system of the preferred embodiments. Any particular key such as a plastic cylinder would also be suitable. It is not necessary for the cylinder-shaped key to be hollow.

Figure 20:
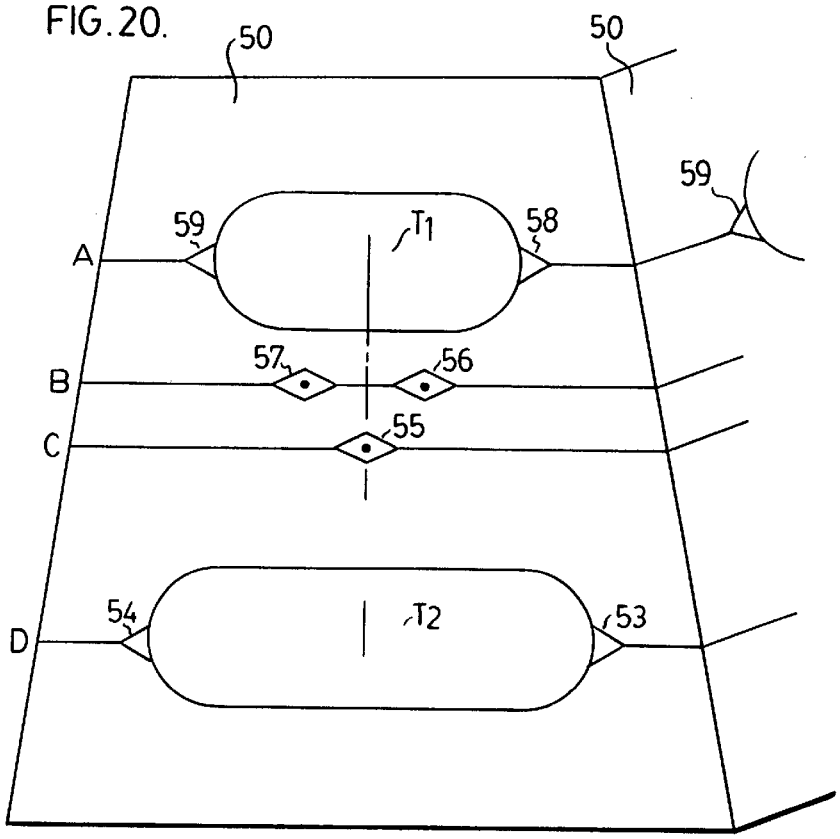
FIG. 20 is a top view of a wedge-shaped block illustrated in an alternative embodiment of the invention.
Figure 21:
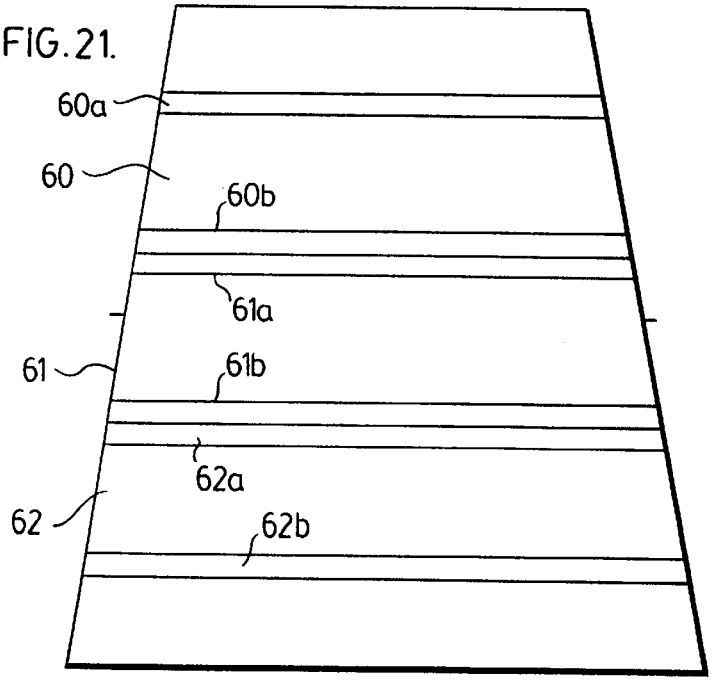
FIG. 21 is a bottom view of the wedge-shaped block of FIG. 20 illustrated in an alternative embodiment of the invention.

Referring now to FIGS. 20 and 21, there is provided another form of a wedge-shaped block 50 having projections centrally disposed 55, 56 and 57 utilized for the same purpose as the projections 17 and 18 of FIG. 1 flanked by projections 54, 53, 59 and 58 equivalent in most respects to the projections 19 and 16 shown in FIG. 1. For example, the projections 59 and 58 together provide for the functioning of the equivalent of projection 16 while the projections 53 and 54 together provide the equivalent of projection 19 in cross section. Obviously, the projections are not as strong as continuous projections extending from side to side of the block construction. However, because of the need to traverse an arc as seen in FIG. 18, it is necessary to provide for the angular movements of the blocks when laying overlapping course upon overlapping courses which are staggered with respect to one another in a typical brick-laying pattern. In order to accomplish this task and still have the projections extend within the channels 60, 61 and 62 having leading and lagging edges 60*a*, 61*a*, 62*a*, 60*b*, 61*b* and 62*b*, respectively, for it to function in most respects as described in relation to FIGS. 5 through 8, it is necessary to provide for the shorter projections. Those skilled in the art will appreciate that when an arc is set in a retaining wall, the projections cannot be continuous.

Referring now to FIGS. 22, 23, 24 and 25, there is illustrated a corner connection for a retaining wall including a superior course and an inferior course wherein the corners 30 illustrated in FIG. 9 are tied into adjacent blocks 10 by the extension of the channel 33*a* as previously mentioned utilizing a concrete chisel C and mallet M to allow the insertion of a key K2 within key ways 32*b*, 33*a* of the corner block 30 and 14*b* of the standard block 10. The corners illustrated in FIGS. 9A and 9B require no extension of preferred channels. In this way, the corners 30 are longitudinally tied into the adjacent block 10 and to inferior and superior courses to reinforce the retaining wall. The superior course is then installed on the inferior course so that the channels and projections as previously described in relation to FIG. 7 and FIG. 15 are completed. The projections 16, 17, 18 and 19 therefore are located and capture the previously described abutments within the channels found on the bottom of the blocks. The same is true for the recesses and abutments found on the top of the block of corner block 30 as previously described. In engaging the projections with the channel abutments and the keys with the key ways with the recesses and key-receiving key ways, the wall so formed is rigidified laterally and longitudinally. The wall of FIG. 22 therefore illustrates cut faces 30*b* and 31 for the corner block to coincide with the split faces 11 of the standard block configuration. The removable extensions having the smooth face 30*a* have been removed from the corner block 30. This is unlike the presentation of FIG. 23 wherein the identical assembly is presented with the exception that smooth faces 30*a* and 30*d* are presented at the corners in relation to the rough split faces 11 of the standard blocks. In order to accomplish this purpose, a channel extending the recess 33*a* is prepared by the installer to align with the space between the projections 17 and 18 of the standard block and/or key-receiving recess 14*b* depending on the groove being aligned therewith of the corner block. The example shown is not the only alternative, but in this case, the channel 32*b* is aligned with the key way of 14*b* and the channel 33*a* is also aligned with the same key way to provide for the insertion of K2, the key in the X and Y direction, to reinforce the retaining wall longitudinally as the superior course is placed upon the inferior course. Otherwise, the joint is identical to that described in relation to FIG. 22.

Figure 24:
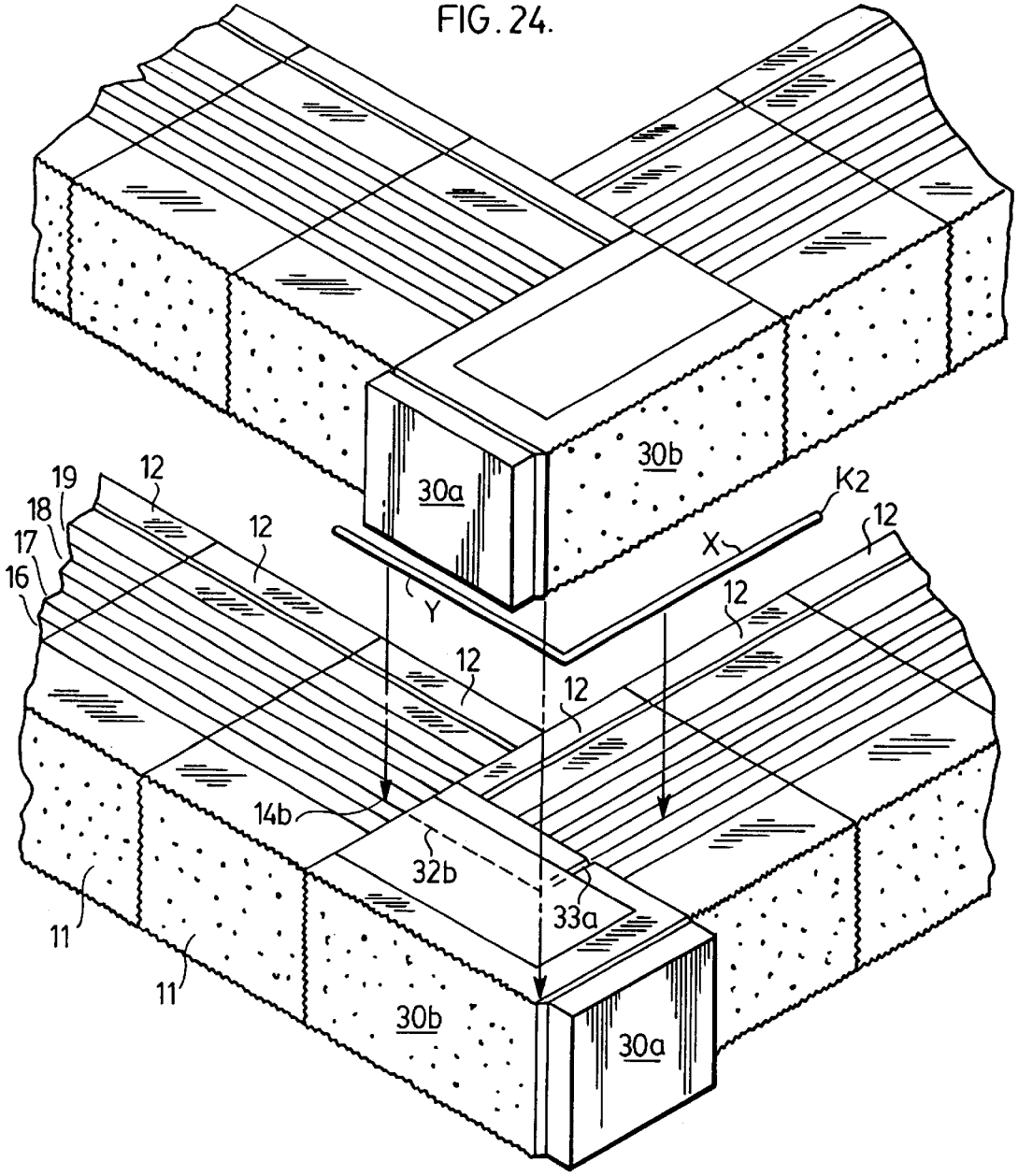
FIG. 24 is a view similar to FIG. 23 with the exception that the smooth face of the corner block is left to protrude from the retaining wall only at the corners thereof.

Referring to FIG. 24, the smooth faces 30*a* are advanced forward of the plane of the retaining wall in one dimension or the other for the superior and the inferior courses. In this manner, a unique corner is prepared and presented. The joint of FIG. 24, however, is identical to that illustrated in relation to FIG. 22 and the creation of same is identical other than the fact that the smooth face extends out from the edge of the corner block 30.

Figure 25:
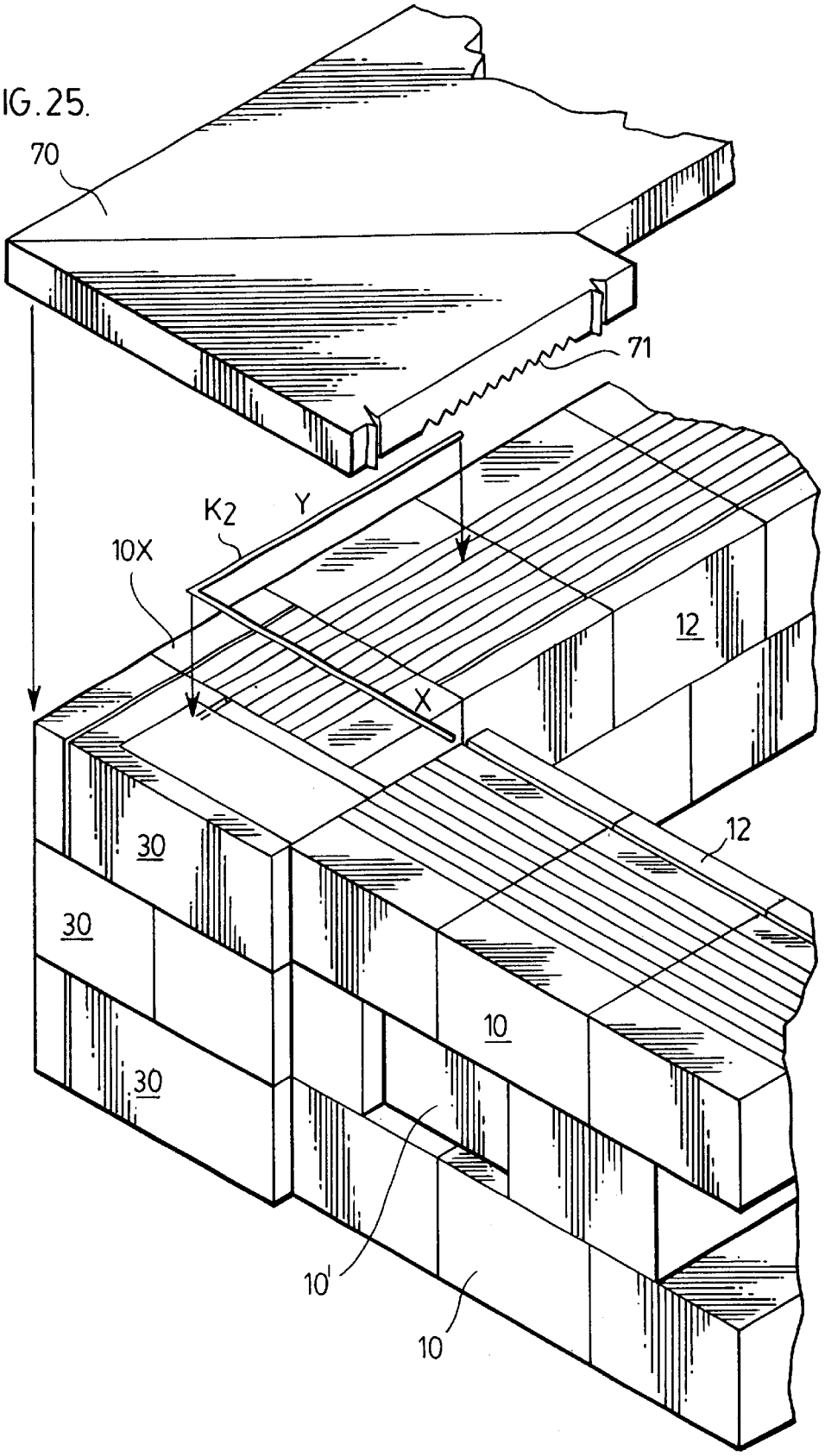
FIG. 25 illustrates a retaining wall of three courses and the manner in which each block is longitudinally connected to the adjacent block illustrated in a preferred embodiment of the invention.

Referring now to FIG. 25, a capping block 70 is presented having a smooth top and a predetermined number of key-receiving recesses 71 proximate the bottom thereof which are utilized in an identical manner when joining the capping with the corners 30 and the standard blocks 10. The only exception is that the block 10X in the configuration of FIG. 25 may be of less width than the block standard 10 in order to compensate for the length of the corner block including the smooth face. Otherwise, the creation of the joint using the key K2 substantially at a right angle is identical when inserted within the grooves found on the bottom of the cap stone 70 at 71 to receive the portion X with the second portion of the capping stone extending in the Y direction for receiving the element Y of the key K2. Otherwise, the assembly of the wall is very similar to those previously described other than the recessed window-like block presentation at 10'.

Figure 26:
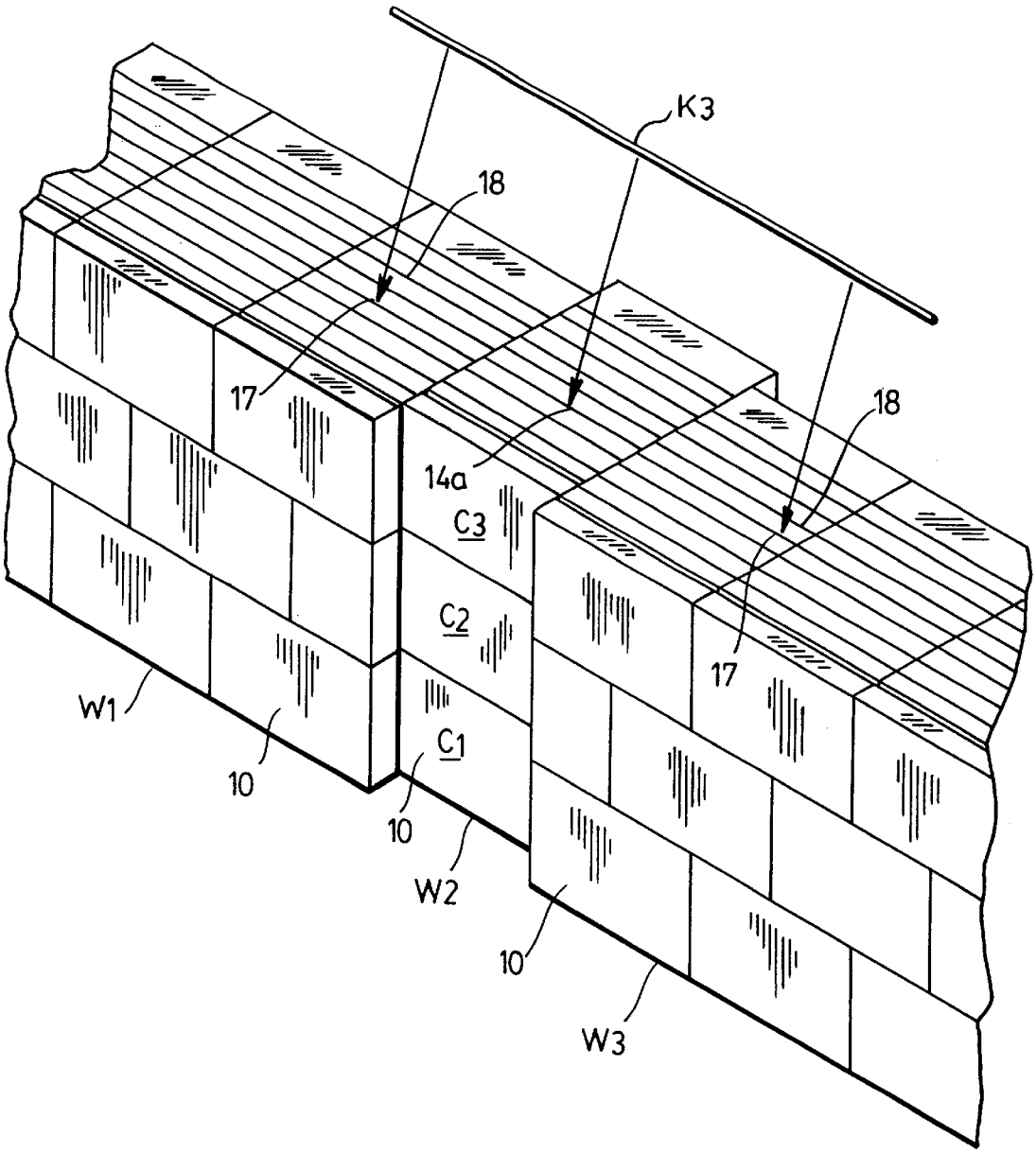
FIG. 26 is a schematic perspective view of a retaining wall constructed from the standard block with the portion of the wall being recessed in relation to the front plane of the wall and illustrated in a preferred embodiment of the invention.

Referring now to FIG. 26, it may be seen that wall sections W1, W2 and W3 of a retaining wall may be formed using the standard blocks 10 which provide for the alignment of the space between projections 17 and 18 with the key-receiving key way 14*a* to allow for the key K3 substantially shown in FIG. 19, or the equivalent thereto, to be inserted therein for each course, C1, C2 and C3 to provide for the interlocking longitudinally of adjacent blocks as well as the interlocking of the superior and inferior courses. The keys also assist in the interlocking of the superior with the inferior courses C1, C2 and C3. The wall portion W2, as is apparent, is recessed from the plane of the walls W1 and W3 to provide an esthetically-pleasing wall construction. The alternative, of course, on the other side of the wall is to have an advanced section of the wall presented to the building owner. This is done in an identical manner.

Referring now to FIG. 27, there is illustrated courses C1, C2, C3 and capping stone 70 assembled in a manner consistent with the embodiment described in relation to FIG. 6. The courses C1, C2 and C3 are therefore set back in relation to the vertical from one another as described with the capping stone capping off the top of the wall section in a manner similar to that described in relation to FIG. 25. Further, in FIG. 28, the retaining wall is formed of courses C1, C2 and C3 which are substantially vertical in disposition to one another and are assembled substantially identically as described in relation to FIG. 7. Otherwise, the structure is identical to FIG. 27 in manufacture. Another embodiment of the invention in relation to a vertical wall may be the presentation of the corners staggered and advanced substantially as shown in FIG. 29 with the corners 30 advanced from the plane of the wall of the blocks 10.

Figure 28:
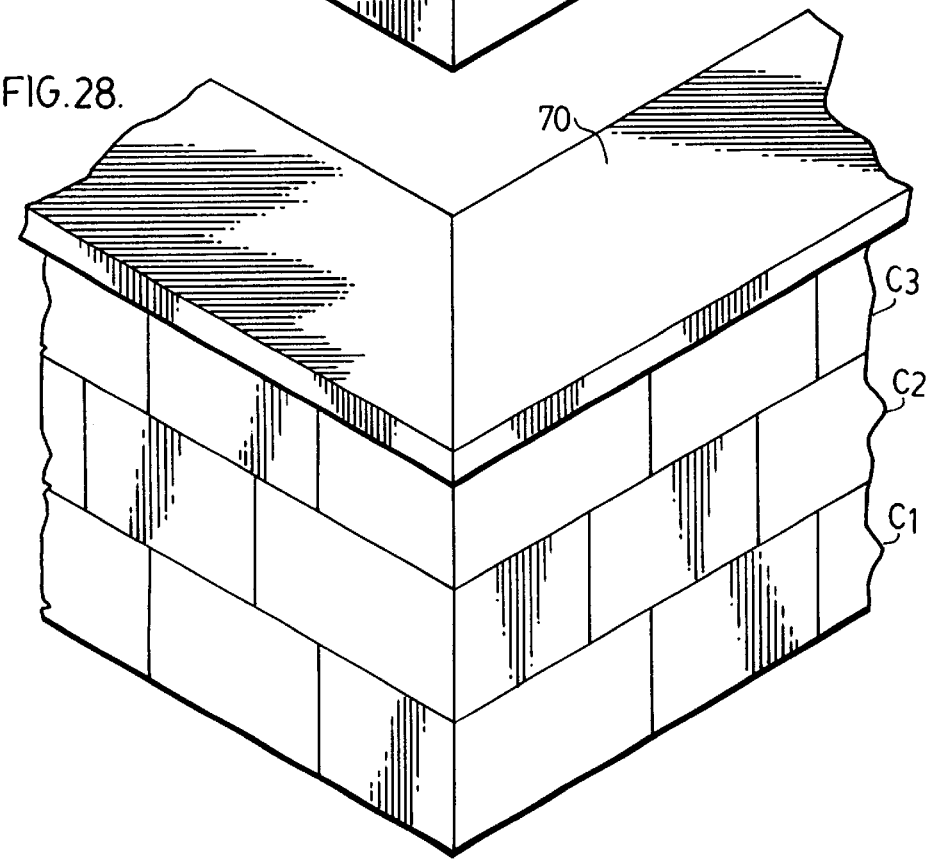
FIG. 28 is a view similar to that of FIG. 27 with the exception that the retaining wall is constructed to be substantially vertical.
Figure 29:
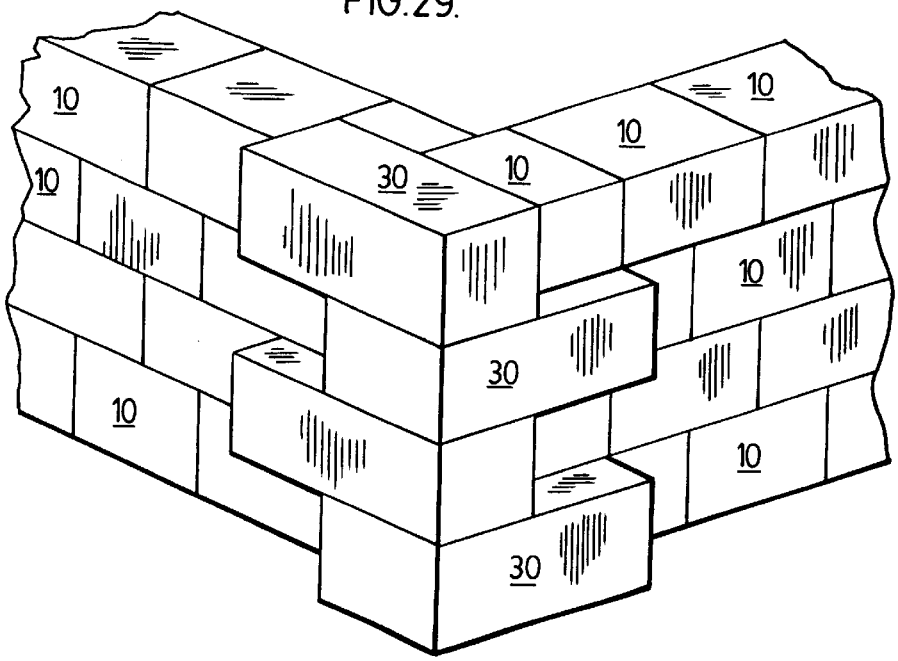
FIG. 29 is a schematic perspective view of a retaining wall constructed in a manner similar to that of FIG. 24 with both the face and the side of the corner block extending beyond the plane of extension of the vertical retaining wall constructed and illustrated in a preferred embodiment of the invention.
Figure 30:
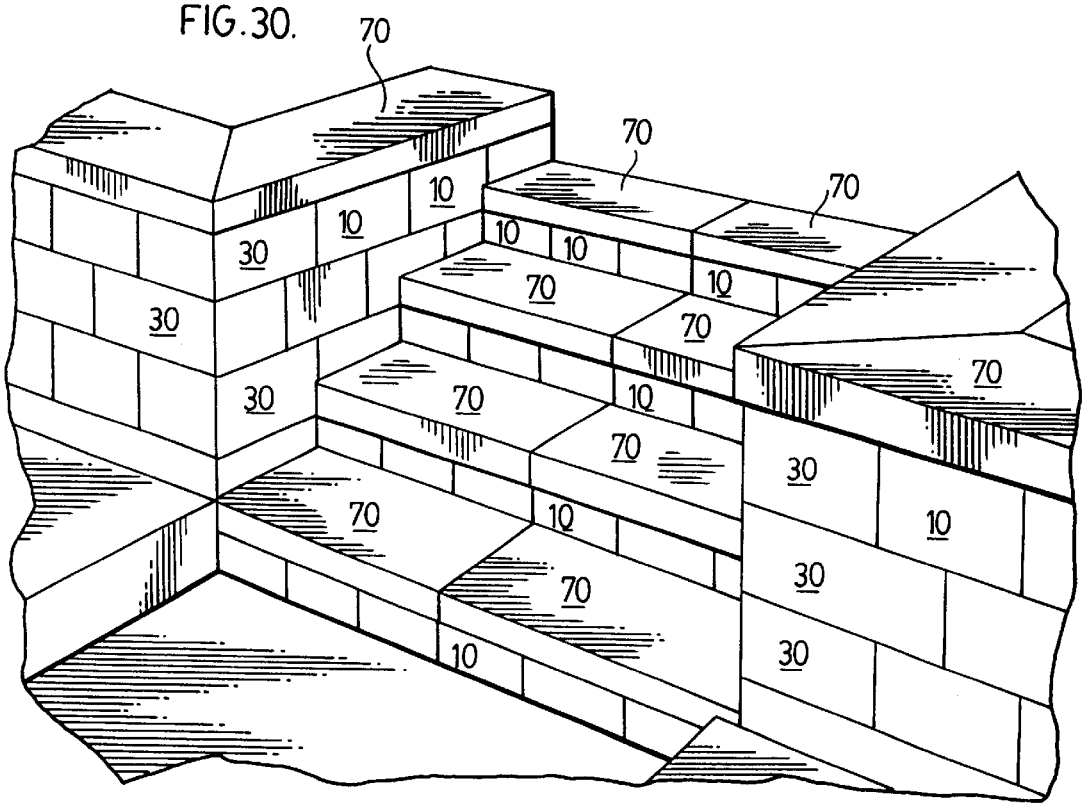
FIG. 30 is a schematic perspective view of a staircase traversing an incline in combination with the retaining wall and illustrated in a preferred embodiment of the invention.
Figure 31:
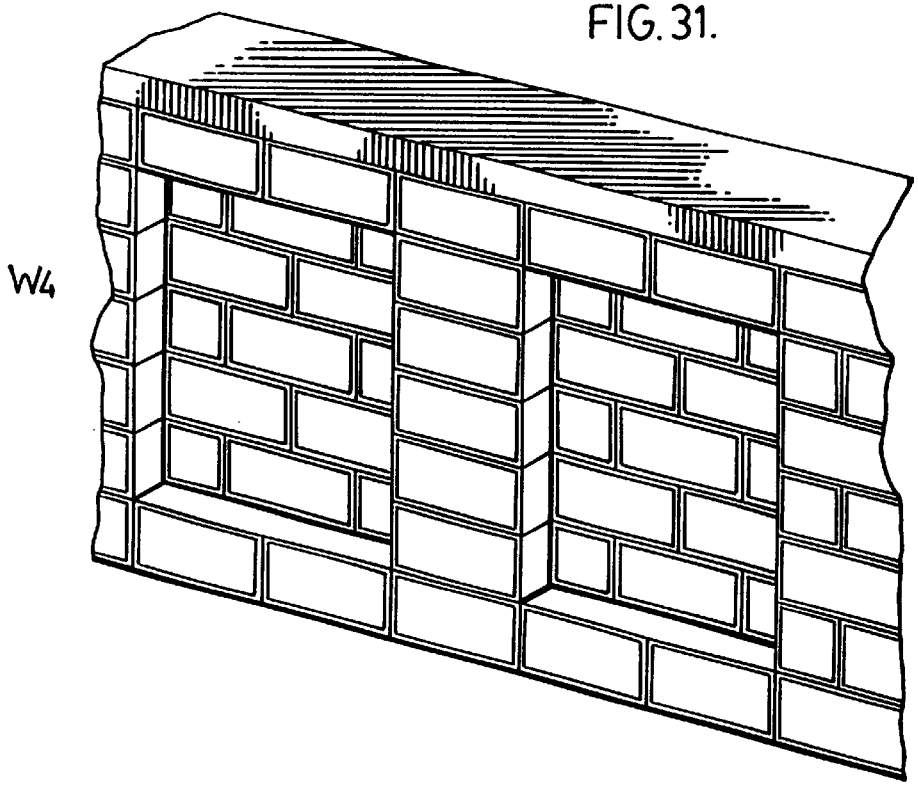
FIG. 31 is a schematic view of one embodiment of the invention.

A more complicated version therefore of the wall structures seen, for example in FIG. 28, would be the providing of walls such as at FIG. 28 having there between disposed a multitude of steps formed from capping stones 70 and standard block modules 10 with the exception of the corners provided as illustrated. In providing the steps within a garden, for example of FIG. 30, it will be noted that the steps do not diverge in length as the wall traverses the incline since the wall can be made in this particular section of the wall from a vertical wall, and it is not required that the wall be set back whatsoever. If setting back is desired, this can be accomplished using the same components. The only difference would be the use of the components by the installer.

Figure 33A:
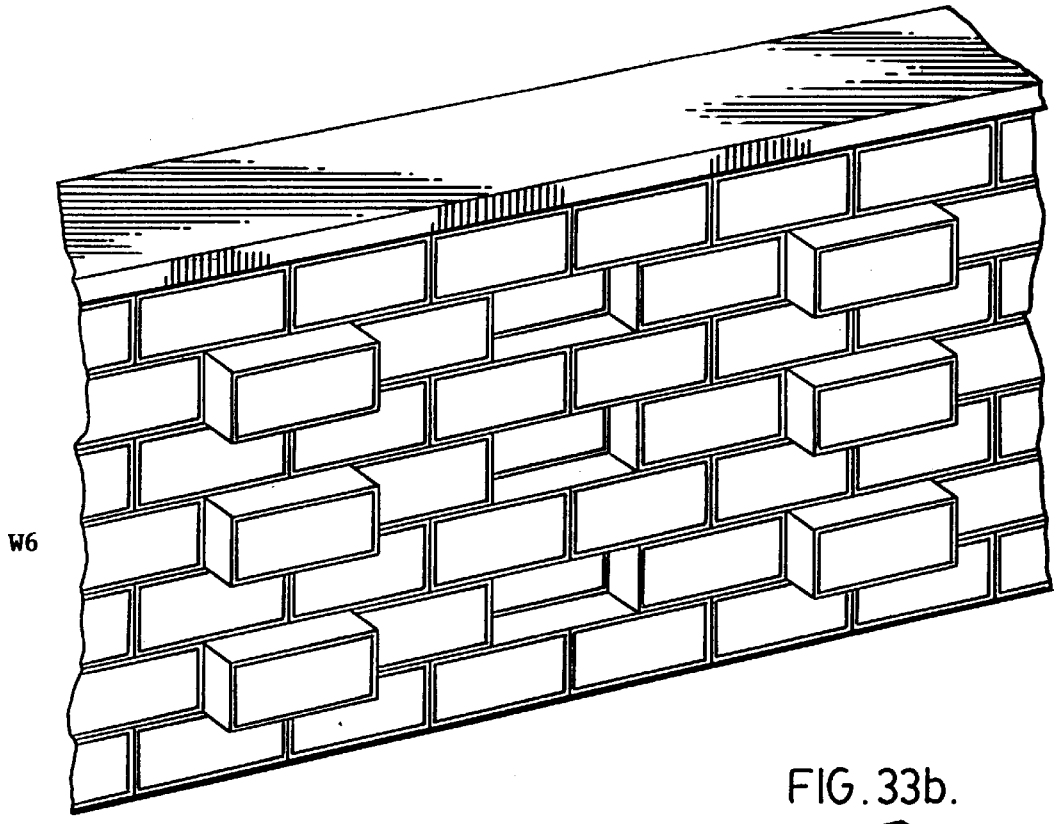
FIGS. 33A and 33B represent two other alternative embodiment s of the invention.
Figure 33B:
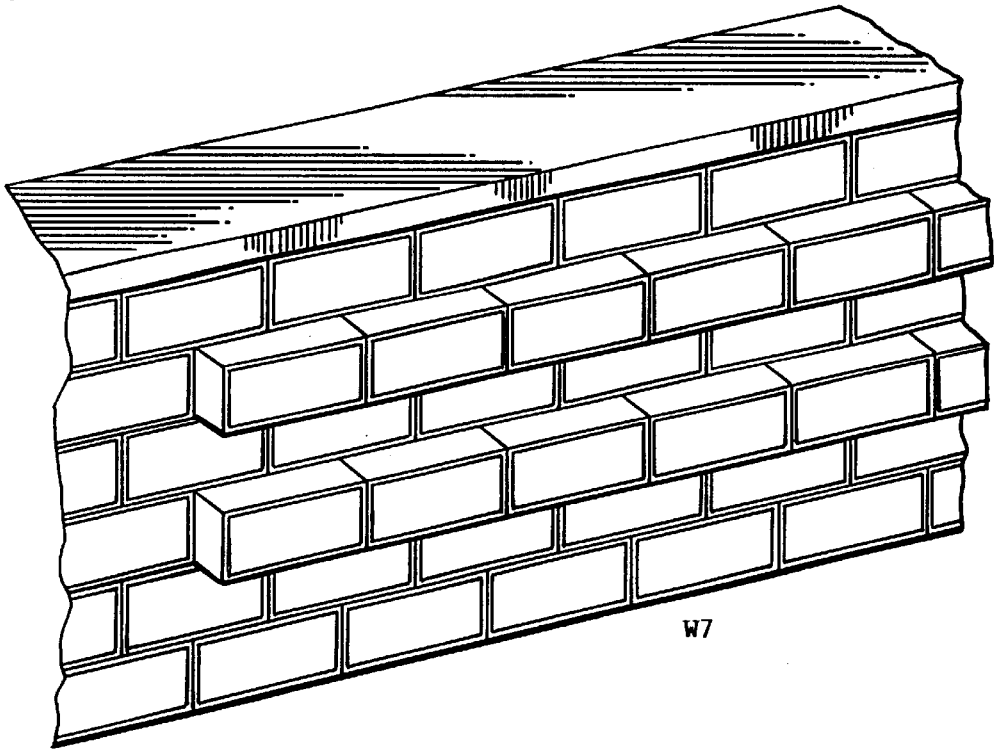

Referring now to FIGS. 31, 32, 33A and 33B, there is presented various wall forms which are possible with combinations of the standard block arrangement utilizing the key K3 or the like. In wall W4, window like panels are recessed within the retaining wall. In wall W5, a predetermined number of blocks are advanced from the plane of the retaining wall. In FIG. 33A blocks are advanced and recessed from the plane of the wall substantially as shown creating a wall W6. In FIG. 33B, another embodiment illustrating wall W7 with a portion of two courses alternating as advanced and being in the plane of the wall is presented.

All of these wall formations and many others as shown in FIGS. 27 through 33B are possible because of the ability of the installer to utilize the features described in relation to FIG. 26 with the key to advance or recess a block or courses of blocks or just one particular array of a course of blocks and still tie in the array being advanced or recessed with adjacent blocks to rigidify the block being advanced or recessed and provide a wall having both lateral and longitudinal stability.

Figure 34:
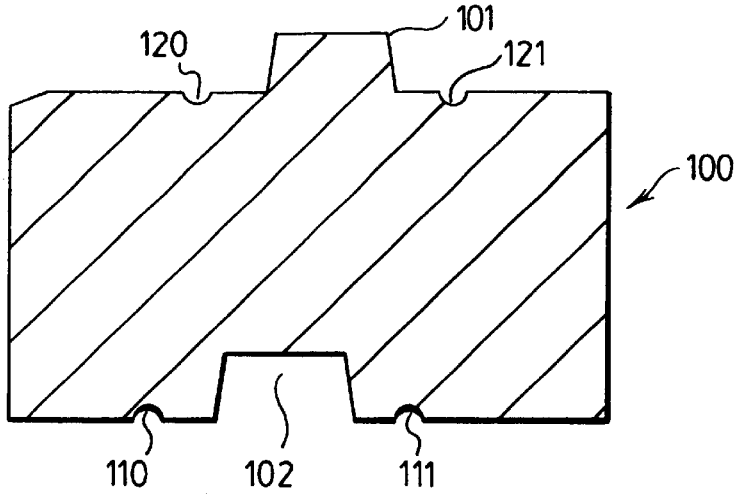
FIGS. 34 and 35 illustrate an improvement to a known block construction illustrated in one embodiment of the invention.
Figure 35:
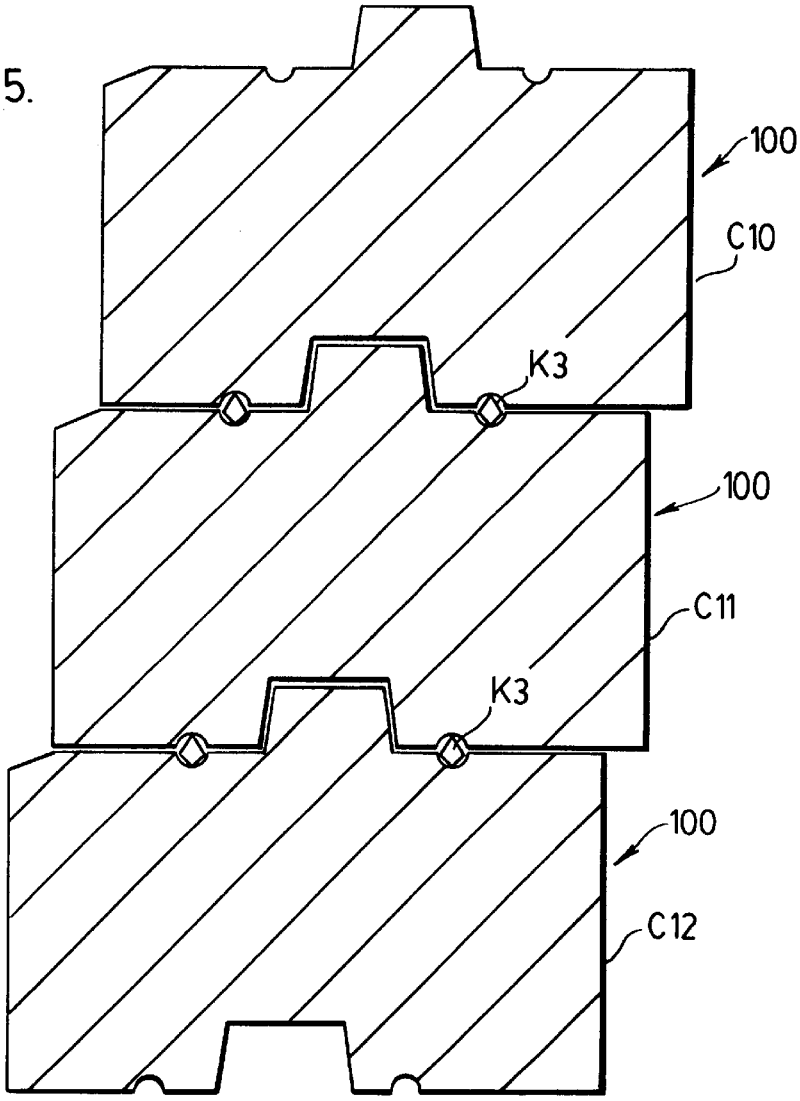

Referring now to FIGS. 34 and 35, there is shown an improvement for a block by Risi which original block was described in the background of the invention. The block 100 includes a projection 101 and a recess 102 which matingly engage and interfit. The improvement includes the provision on the top and bottom of said block with key-receiving recesses 120, 121, 110 and 111 which allow for tying in of adjacent blocks substantially as illustrated in FIG. 35 wherein courses C10, C11 and C12 are tied in with adjacent blocks and further with inferior and superior courses utilizing keys K3 to interconnect said blocks with said recesses 110, 111, 120 and 121. In providing the improvement to these blocks of FIGS. 34 and 35, it is possible to construct some of the various embodiments previously described and illustrated in relation to a vertical and a set-back wall construction and specifically in conjunction with the aforementioned corner blocks.

Figure 36:
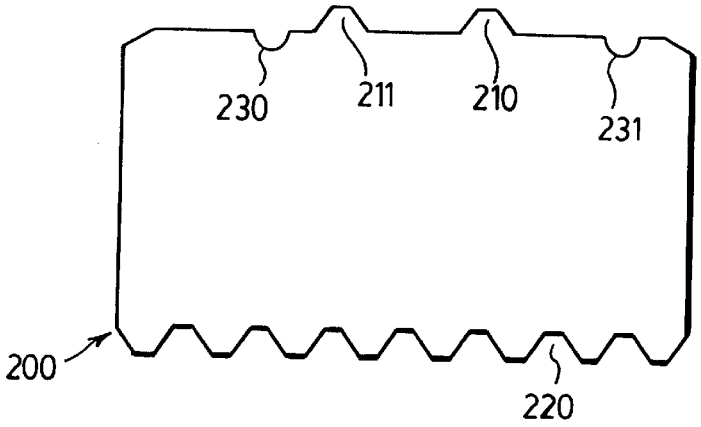
FIGS. 36 and 37 represent an improvement of a known block and illustrated in another embodiment of the invention.
Figure 37:
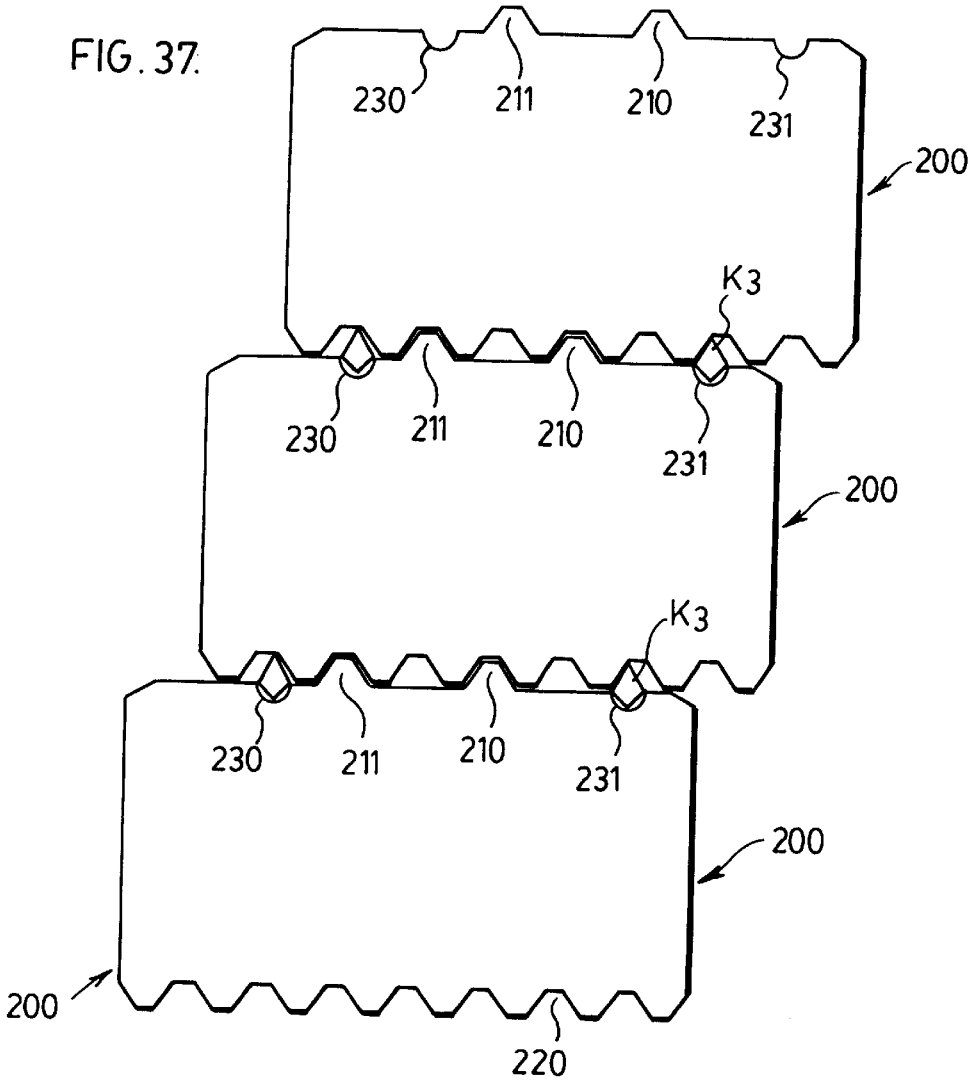

Referring now to FIGS. 36 and 37, there is illustrated improvements for the block 200 by Bender which original block structure was described above in the background of the invention. The block has two projections 210 and 211 disposed therewith for stacking in courses with like blocks including a bottom having a multitude of recesses 220 disposed therewith. The improvement includes the provision of key-receiving recesses 230 and 231 on the top of the block which may be utilized with the recesses 220 proximate the bottom of the block which are not utilized for capturing the projections 210 and 211 so as to tie into the superior and inferior courses as best seen in FIG. 37 and as well to tie in longitudinally any adjacent blocks with one another as a retaining wall is built.

A provision for tying in the retaining walls formed above to the surrounding soil may be accomplished by trapping netting such as Geogrid or mesh between courses of the wall as required by the installation without providing the other limitations found therein.

As many changes can be made to the embodiments of the invention without departing from the scope of the invention, it is intended that all material herein be interpreted as illustrative of the invention and not in a limiting sense.

The embodiments of the invention in which an exclusive property or privilegeis claimed are as follows:

1. A dual-block module comprising two blocks joined together proximate one face thereof and comprising substantial mirror images of one another, each block having disposed proximate the opposite faces which are not joined a removable section to present either a smooth face for the block when the removable section is retained, or a rough split face for the block when the removable section is removed, the block including a scoreline prior to the removable section to enable an installer to remove that section as required further comprising a corner block joined at the side edges thereof and including two mirror image blocks joined at said edge, each of said blocks having a pair of exposed faces, at least one of said faces including a removable portion separated from said block by a scoreline so as to allow an installer to remove said removable portion, wherein said corner block may present a pair of smooth faces when exposed, or alternatively a smooth and a rough split face as exposed, and finally two split faces as exposed.

2. A module for a block comprising two blocks formed face to face including a scoreline to enable an installer to split the mirror image blocks and separate them one from another, each block having disposed proximate its other face a removable section separated from the block by a scoreline to enable removing of that section, said removable section providing a smooth face for the other face of the block when the removable section is not removed, and a rough split face for the block when the removable section is removed further comprising a corner block joined at the side edges thereof and including two mirror image blocks joined at said edge, each of said blocks having a pair of exposed faces, at least one of said faces including a removable portion separated from said block by a scoreline so as to allow an installer to remove said removable portion, wherein said corner block may present a pair of smooth faces when exposed, or alternatively a smooth and a rough split face as exposed, and finally two split faces as exposed.

3. The module of claim 1 or 2 wherein discrete recesses and projections extend from the top and/or bottom of said corner blocks which engage with like discrete recesses and projections when stacked course upon course.

4. The module of claim 1 or 2 wherein said key-receiving key ways extend between the faces of said blocks joined at 90° to key ways extending from side to side of said blocks.

5. The module of claim 4 wherein the second key ways are only provided in part being completed by an installer during the installation of a retaining wall system.

6. A corner block joined at the side edges thereof and including two mirror image blocks joined at said edge, each of said blocks having a pair of exposed faces, at least one of said faces including a removable portion separated from said block by a scoreline so as to allow an installer to remove said removable portion, wherein said corner block may present a pair of smooth faces when exposed, or alternatively a smooth and a rough split face as exposed, wherein said blocks. including key-receiving key ways disposed proximate the top and bottom thereof.

7. The block of claim 6 wherein said key-receiving key ways extend between faces of said blocks joined at substantially 90° to key ways extending from side to side of said blocks.

8. The block of claim 6 wherein discrete recesses and projections extend from the top and/or bottom of said corner blocks which engage with like discrete recesses and projections when stacked course upon course.

9. A corner block comprising a top and bottom and having disposed proximate the top and bottom a predetermined number of grooves on both said top and bottom which engage with one or more abutment means of another block stacked in an inferior or superior course when a retaining wall is formed, said corner block said other block including grooves extending in two directions proximate the top and/or bottom thereof to tie in with adjacent blocks utilizing supplementary keys provided to assemble the retaining wall with at least one of the grooves being extendible by an installer during installation.

* * * * *